US008166607B2

(12) United States Patent
Conrad

(10) Patent No.: US 8,166,607 B2
(45) Date of Patent: May 1, 2012

(54) UPRIGHT VACUUM CLEANER

(75) Inventor: Wayne Ernest Conrad, Hampton (CA)

(73) Assignee: G.B.D. Corp, Nassau (BS)

( * ) Notice: Subject to any disclaimer, the term of this patent is extended or adjusted under 35 U.S.C. 154(b) by 215 days.

(21) Appl. No.: 11/954,310

(22) Filed: Dec. 12, 2007

(65) Prior Publication Data

US 2008/0178420 A1 Jul. 31, 2008

Related U.S. Application Data

(60) Provisional application No. 60/869,586, filed on Dec. 12, 2006.

(51) Int. Cl.
*A47L 9/00* (2006.01)
*A47L 9/10* (2006.01)
*A47L 9/20* (2006.01)

(52) U.S. Cl. ..... 15/334; 15/331; 15/353

(58) Field of Classification Search ..... 15/353, 15/331, 334

See application file for complete search history.

(56) References Cited

U.S. PATENT DOCUMENTS

| | | | |
|---|---|---|---|
| 1,759,947 | A | 1/1924 | Lee, Ralph L. |
| 2,210,950 | A | 8/1940 | Replogle, D. B. |
| 2,993,223 | A | 7/1961 | Krammes |
| 4,393,536 | A | 7/1983 | Tapp |
| 5,054,157 | A | 10/1991 | Werner et al. |
| 5,309,600 | A | 5/1994 | Weaver et al. |
| 5,524,321 | A | 6/1996 | Weaver et al. |
| 5,836,047 | A | 11/1998 | Lee et al. |
| 6,058,559 | A | 5/2000 | Yoshimi et al. |
| 6,094,775 | A | 8/2000 | Behmer |
| 6,122,796 | A | 9/2000 | Downham et al. |
| 6,243,916 | B1 | 6/2001 | Embree et al. |
| 6,289,553 | B1 | 9/2001 | Dyson |
| 6,295,692 | B1 | 10/2001 | Shideler |
| 6,317,920 | B1 | 11/2001 | Brickner et al. |
| 6,334,234 | B1 * | 1/2002 | Conrad et al. ..... 15/347 |
| 6,374,453 | B1 | 4/2002 | Kim |
| 6,440,197 | B1 | 8/2002 | Conrad et al. |

(Continued)

FOREIGN PATENT DOCUMENTS

CA 2436555 A1 2/2004

(Continued)

OTHER PUBLICATIONS

Supplementary Search Report received on the corresponding Euopean Patent Application No. 07855510.9, mailed on May 26, 2010.

(Continued)

*Primary Examiner* — Bryan R Muller

(74) *Attorney, Agent, or Firm* — Bereskin & Parr LLP/S.E.N.C.R.L., s.r.l.; Philip C. Mendes da Costa

(57) ABSTRACT

Several embodiments of an upright surface cleaning apparatus are disclosed. The surface cleaning apparatus has a first cyclonic cleaning stage and comprises a surface cleaning head having a dirty fluid inlet. A fluid flow path extends from the dirty fluid inlet to a clean air outlet of the upright surface cleaning apparatus. A support member is mounted to the surface cleaning head. A mounting member mounted to the support member. At least one of a first cleaning stage of the upright surface cleaning apparatus and a suction motor is mounted directly or indirectly to the mounting member. A suction motor is provided in the fluid flow path.

81 Claims, 24 Drawing Sheets

U.S. PATENT DOCUMENTS

| | | | | |
|---|---|---|---|---|
| 6,497,001 | B2 | 12/2002 | Di Nunzio et al. | |
| 6,532,621 | B2 | 3/2003 | Stephens et al. | |
| 6,574,831 | B2 | 6/2003 | Hunter et al. | |
| 6,735,818 | B2 | 5/2004 | Hamada et al. | |
| 6,766,559 | B2 | 7/2004 | Roney et al. | |
| 6,779,229 | B2 | 8/2004 | Lee et al. | |
| 6,807,708 | B2 | 10/2004 | Roney et al. | |
| 6,839,934 | B2 | 1/2005 | Houghton et al. | |
| 6,948,212 | B2 | 9/2005 | Oh et al. | |
| 6,961,975 | B2 | 11/2005 | Park et al. | |
| 7,014,671 | B2 | 3/2006 | Oh | |
| 7,140,068 | B1 | 11/2006 | Vander Baan et al. | |
| 7,188,388 | B2 | 3/2007 | Best et al. | |
| 7,350,266 | B2 | 4/2008 | Park et al. | |
| 7,360,274 | B2 | 4/2008 | Park et al. | |
| 7,377,007 | B2 | 5/2008 | Best | |
| 7,377,008 | B2 | 5/2008 | Park et al. | |
| 2003/0131441 | A1 | 7/2003 | Murphy et al. | |
| 2003/0159411 | A1 | 8/2003 | Hansen et al. | |
| 2004/0060144 | A1* | 4/2004 | Bowden et al. | 15/334 |
| 2004/0216263 | A1* | 11/2004 | Best et al. | 15/331 |
| 2005/0235454 | A1* | 10/2005 | Courtney | 15/351 |
| 2006/0070205 | A1* | 4/2006 | Fischer et al. | 15/334 |
| 2006/0230715 | A1 | 10/2006 | Oh et al. | |

FOREIGN PATENT DOCUMENTS

| | | | |
|---|---|---|---|
| CA | 2495073 | A1 | 2/2004 |
| CA | 2551200 | A1 | 2/2004 |
| CA | 2522159 | A1 | 4/2006 |
| CA | 2423405 | C | 10/2006 |
| CA | 2581799 | A1 | 9/2007 |
| CN | 2592103 | Y | 12/2003 |
| GB | 2416296 | B | 6/2007 |
| JP | 2004-344642 | | 12/2004 |
| WO | W02004069021 | A1 | 8/2004 |

OTHER PUBLICATIONS

The Office Action received in connection to the corresponding Chinese Patent Application No. 200780051146.7, Feb. 23, 2011.

Office Action which issued in connection to the corresponding Canadian Patent Application No. 2,677,530.

* cited by examiner

UPRIGHT VACUUM CLEANER

CROSS-REFERENCES TO RELATED APPLICATIONS

The invention claims priority from U.S. Provisional patent application 60/869,586, filed on Dec. 12, 2006, which is incorporated herein by reference in its entirety.

FIELD OF THE INVENTION

The invention relates to a surface cleaning apparatus. More specifically, the invention relates to an upright surface cleaning apparatus that includes a mounting member to which one or more components of an upper section are mounted.

BACKGROUND OF THE INVENTION

Upright cyclonic vacuum cleaners are known in the art. Typical upright cyclonic vacuum cleaners include an upper section, including the cyclone assembly, mounted to a surface cleaning head. An upflow conduit is typically provided between the surface cleaning head and the upper section. In some such vacuum cleaners, a spine or backbone extends between the surface cleaning head and the upper section for supporting the upper section. In other vacuum cleaners, a spine or backbone is not provided, and the upflow conduit supports the upper section. For example, U.S. Pat. No. 1,759,947 to Lee describes an upright cyclonic vacuum cleaner wherein the upper section includes a single cyclone. A conduit extends from the surface cleaning head into the bottom of the cyclone and upwards towards the top of the cyclone. Air exits the conduit at the top potion of the cyclone. Another upright cyclonic vacuum cleaner is disclosed in U.S. Pat. No. 6,334,234 to Conrad. In the cleaner, the upper section includes a first cyclonic cleaning stage comprising a single cyclone, and a second cyclonic cleaning stage comprising a plurality of cyclones mounted above the first cyclonic cleaning stage. A conduit extends from the surface cleaning head through the bottom of the first cyclone and upwards toward the top of the first cyclone.

SUMMARY OF THE INVENTION

In accordance with one broad aspect, an upright surface cleaning apparatus is provided. The upright surface cleaning apparatus has a first cyclonic cleaning stage and comprises a surface cleaning head having a dirty fluid inlet. A fluid flow path extends from the dirty fluid inlet to a clean air outlet of the upright surface cleaning apparatus. A support member is mounted to the surface cleaning head, and a mounting member mounted to the support member. At least two operating components of the upright surface cleaning apparatus, including a cleaning stage, are mounted directly or indirectly to the mounting member. A suction motor is provided in the fluid flow path downstream of the cleaning stage. According to this aspect, the mounting member, which preferably has an air flow conduit therethrough, may be used as a hub to which operating components, e.g., one or more of a cyclone casing, a filter casing and a motor casings, are attached.

Embodiments in accordance with this broad aspect may be advantageous because various components, such as the suction motor and/or the cleaning stage may be relatively easily removed from the surface cleaning apparatus, and therefore may be easily repaired or cleaned.

In some embodiments, the support member comprises an airflow duct forming part of the fluid flow path. In some other embodiments, the airflow duct is an up flow duct and the mounting member has an airflow passage therethrough in air flow communication with the first cyclonic cleaning stage.

In some embodiments, the cleaning stage comprises a cyclonic cleaning stage and another of the operating components comprises the suction motor.

In some embodiments, the cleaning stage comprises a cyclonic cleaning stage, another of the operating components comprises the suction motor, and the suction motor is mounted above the cyclonic cleaning stage. In some further embodiments, the cyclonic cleaning stage comprises a cyclone housing that is mounted directly or indirectly to the mounting member, a filter is positioned downstream to the cyclonic cleaning stage and the suction motor is mounted to a housing in which the filter is located. In some such embodiments, the filter is provided in the cyclone housing and the suction motor is mounted to the cyclone housing. In other such embodiments, the filter is provided in a filter housing that is mounted to the cyclone housing and the suction motor is mounted to the filter member.

In some embodiments, at least one of the operating components is removably mounted to the mounting member.

In some embodiments, the mounting member includes an air flow valve.

In some embodiments, the apparatus further comprises an above floor cleaning wand mounted to the mounting member or an operating component mounted to thereto.

In some embodiments, the upright surface cleaning apparatus comprises an upper portion comprising the suction motor and the cleaning stage and the upper portion is removably mounted to the surface cleaning head and useable as a portable surface cleaning apparatus.

In some embodiments, the cleaning stage comprises a first cyclonic cleaning stage and additional operating components comprise a second cyclonic cleaning stage and the suction motor. In some further embodiments, at least two of the first cyclonic cleaning stage, the second cyclonic cleaning stage and the suction motor are mounted directly to the mounting member. In yet further embodiments, the first cyclonic cleaning stage has a longitudinally extending outer surface and the outer surface is visible except for a portion facing the support member.

In some embodiments, the support member comprises an air flow duct forming part of the fluid flow path.

In accordance with another broad alternate aspect, an upright surface cleaning apparatus is provided. The upright surface cleaning apparatus comprises a surface cleaning head having a first dirty fluid inlet. The upright surface cleaning apparatus further comprises an above floor cleaning wand having a second dirty fluid inlet. An upright section is pivotally mounted to the surface cleaning head and comprises a support member and a first cyclonic cleaning stage selectively connectable in fluid flow communication with the first dirty fluid inlet and the second dirty fluid inlet. The first cyclonic cleaning stage has a longitudinally extending outer surface and the outer surface is visible except for a portion facing the support member. Air flow passages from each of the first and second dirty fluid inlets merge at a position proximate the inlet of the first cyclonic cleaning stage. A suction motor is positioned downstream from the first cyclonic cleaning stage. Such a design may be optionally used with a mounting member.

In some embodiments, the suction motor is mounted on the upright section. In some embodiments, the suction motor is mounted above the first cyclonic cleaning stage.

In some embodiments, the support member is an up flow duct in a fluid flow path from the first dirty fluid inlet to the first cyclonic cleaning stage.

In some embodiments, the first cyclonic cleaning stage is removably mounted to the upper section.

In some embodiments, the first cyclonic cleaning stage comprises at least one collection chamber and the collection chamber is removably mounted to the first cyclonic cleaning stage.

In some embodiments, the support member comprises an up flow duct in a fluid flow path from the first dirty fluid inlet to the first cyclonic cleaning stage and the first cyclonic cleaning stage is mounted directly or indirectly to the upflow duct. In some such embodiments, the suction motor is mounted directly or indirectly to the upflow duct.

In some embodiments, the support member comprises an up flow duct in a fluid flow path from the first dirty fluid inlet to the first cyclonic cleaning stage and the first cyclonic cleaning stage, a second cyclonic cleaning stage and the suction motor are mounted directly to the upflow duct or a component mounted to the upflow duct.

In some embodiments, the apparatus further comprises a cleaning and suction unit removably mounted to the surface cleaning apparatus and useable as a portable surface cleaning apparatus, the cleaning and suction unit comprising the suction motor, the first cyclonic cleaning stage and the above floor cleaning wand.

In some embodiments, the support member is an up flow duct in a fluid flow path from the first dirty fluid inlet to the first cyclonic cleaning stage and the cleaning and suction unit removably mounted to the upflow duct.

In accordance with another alternate broad aspect, an upright surface cleaning apparatus is provided. The upright surface cleaning apparatus comprises a surface cleaning head having a first dirty fluid inlet. The upright surface cleaning apparatus further comprises an above floor cleaning wand having a second dirty fluid inlet. An upright section is pivotally mounted to the surface cleaning head and comprises a cleaning and suction unit removably mounted to the surface cleaning apparatus and useable as a portable surface cleaning apparatus. The cleaning and suction unit comprises a suction motor, a first cyclonic cleaning stage, and the above floor cleaning wand. The first cyclonic cleaning stage is selectively connectable in fluid flow communication with the first dirty fluid inlet and the second dirty fluid inlet. The first cyclonic cleaning stage has a longitudinally extending outer surface and the outer surface is visible except for a portion facing the support member. Such a design may be optionally used with by itself or with one or both of either of the forgoing aspects.

In some embodiments, the upright section is pivotally mounted to the surface cleaning head by a support member that is an up flow duct in a fluid flow path from the first dirty fluid inlet to the first cyclonic cleaning stage.

In some embodiments, the first cyclonic cleaning stage is removably mounted to the cleaning and suction unit.

In some embodiments, the first cyclonic cleaning stage comprises at least one collection chamber and the collection chamber is removably mounted to the first cyclonic cleaning stage.

In some embodiments, the upright section is pivotally mounted to the surface cleaning head by a support member that comprises an up flow duct in a fluid flow path from the first dirty fluid inlet to the first cyclonic cleaning stage, and the first cyclonic cleaning stage, a second cyclonic cleaning stage and the suction motor are mounted directly to the upflow duct or a component mounted to the upflow duct.

BRIEF DESCRIPTION OF THE DRAWINGS

These and other advantages of the instant invention will be more fully and completely understood in accordance with the following drawings of the preferred embodiments of the vacuum cleaner in which.

DETAILED DESCRIPTION OF THE INVENTION

Figure 1:
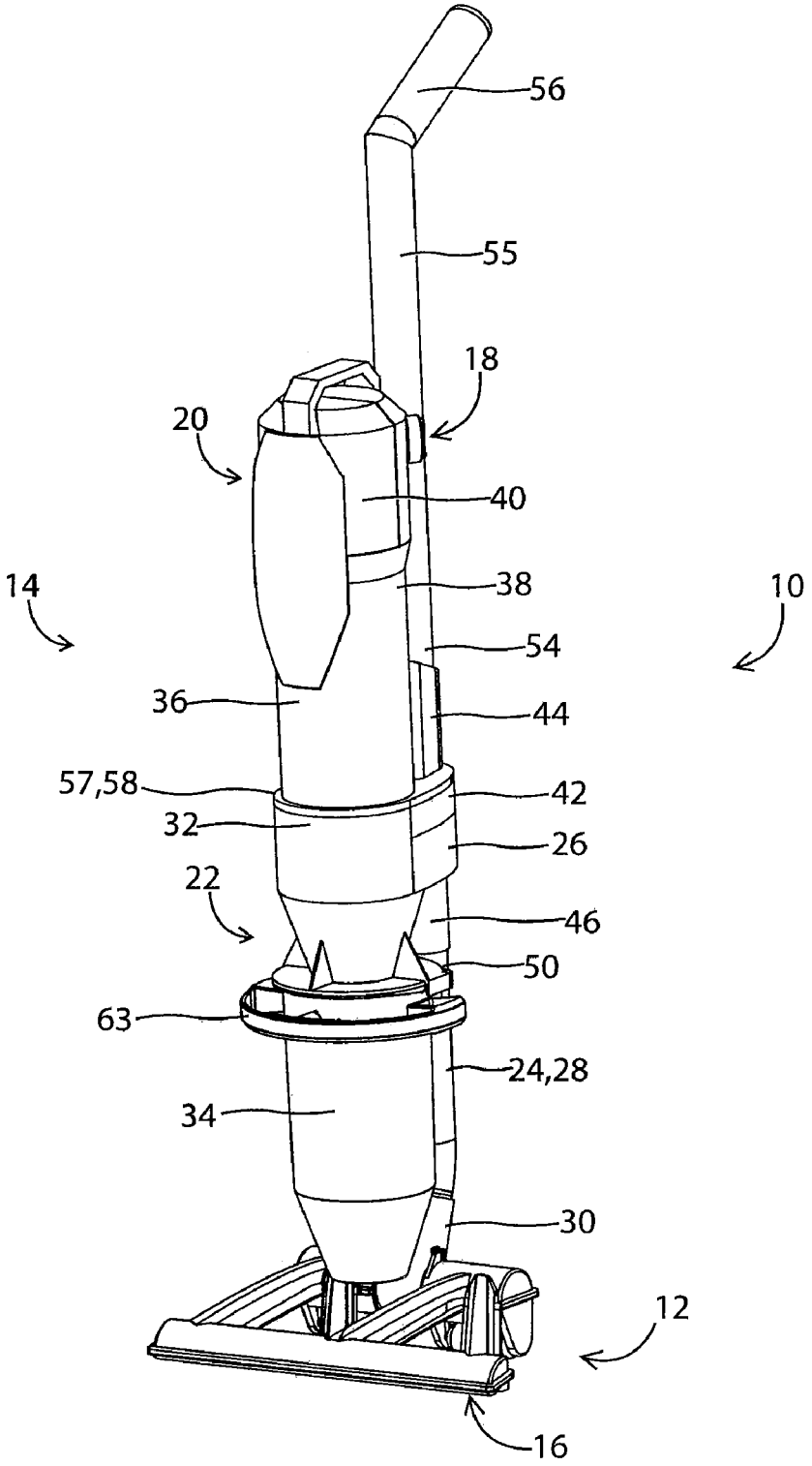
FIG. 1 is a perspective view of an upright vacuum cleaner according to a first embodiment of the instant invention.
Figure 2:
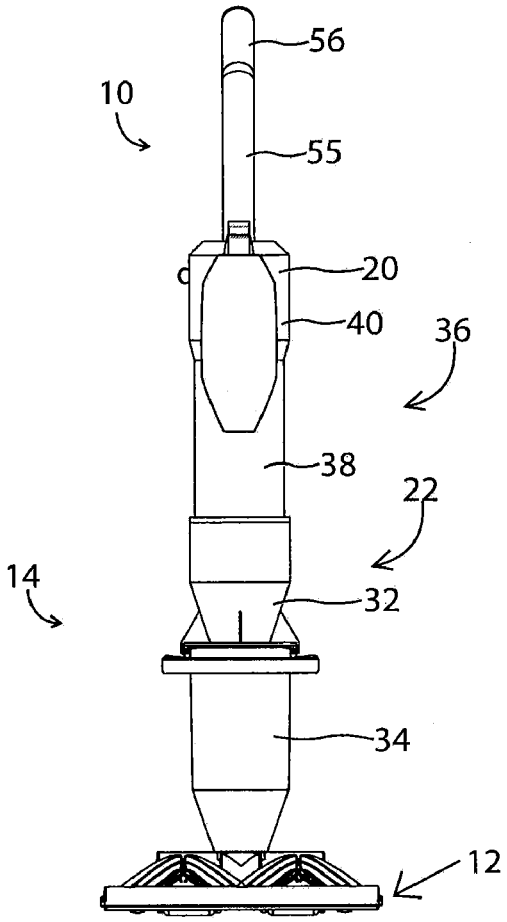
FIG. 2 is a front elevational view of the vacuum cleaner of FIG. 1.
Figure 3:
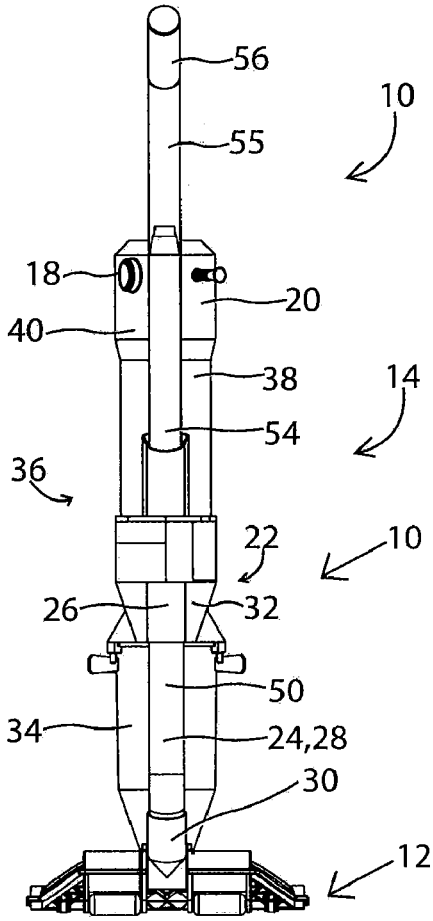
FIG. 3 is a rear elevational view of the upright vacuum cleaner of FIG. 1.
Figure 4:
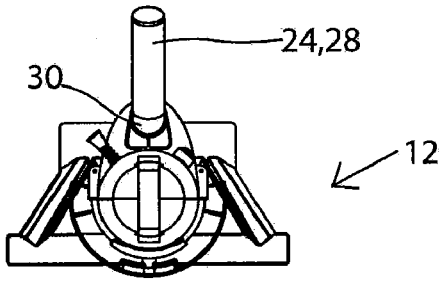
FIG. 4 is a top plan view of the upright vacuum cleaner of FIG. 1.

Referring to FIGS. 1-5 an embodiment of a surface cleaning apparatus 10 of the present invention is shown. Surface cleaning apparatus 10 is an upright vacuum cleaner, and comprises a surface cleaning head 12 and an upper section 14. A dirty fluid inlet 16 is provided in the surface cleaning head 12, and a fluid flow path extends from the dirty fluid inlet 16 to a clean air outlet 18 of the surface cleaning apparatus 10. The fluid flow path includes a suction motor 20 and at least one cleaning stage 22. In the embodiments shown, a support member or spine 24 is mounted to the surface cleaning head 12, and a mounting member 26 is mounted to the support member. At least two operating components of the surface cleaning apparatus 10 are mounted directly or indirectly to the mounting member. Accordingly, the support member supports the upper section 14 on the surface cleaning head 12.

In the embodiments shown, fluid enters surface cleaning head via dirty fluid inlet 16 in surface cleaning head 12, and is directed upwards into the at least one cleaning stage via an upflow duct 28. In some embodiments, as shown, support member 24 comprises upflow duct 28. That is, support member 24 provides fluid communication between surface cleaning head 12 and upper section 14. In other embodiments, upflow duct 28 may be a separate member. For example, upflow duct 28 may be a conduit that is affixed to support member 24. In the embodiments shown, support member 24 is pivotally mounted to surface cleaning head 12 via a pivoting connector 30. Accordingly, upper section 14 is pivotally mounted to surface cleaning head 12.

In the embodiments shown, support member 24 extends upwardly towards mounting member 26. Mounting member 26 serves as a support to which at least two operating components of the upright surface cleaning apparatus 10 are mounted. In the preferred embodiment, cleaning stage 22 is directly or indirectly mounted to mounting member 26, as will be described further hereinbelow. In a further preferred embodiment, cleaning stage 22 and suction motor 20 are directly or indirectly mounted to mounting member 26. In other embodiments, other operating components, such as a filter assembly or another cleaning stage, may be mounted to mounting member 26. In some embodiments, mounting member 26 may be integrally formed with support member 24. In other embodiments, as shown in FIGS. 21-22, mounting member 26 may be integrally formed a component of upper section 14, for example cyclonic cleaning stage 22. In other embodiments, mounting member 26 may be a separate member. As exemplified, mounting member may have a fluid flow path therethrough (see for example FIG. 7) or it may not include a fluid flow path therethrough.

In embodiments wherein support 24 comprises upflow duct 28, mounting member 26 may further serve to connect support 24 in fluid communication with cyclonic cleaning stage 22. That is, mounting member 26 may comprise an airflow passage 31 (shown in FIGS. 7, 8, 21-22, and 23-28). In alternate embodiments (not shown), a mounting member may not be provided, and support 24 may be mounted directly to cyclonic cleaning stage 22. In further alternate embodiments, wherein upflow duct 28 is a separate member, a mounting member may not be provided, and upflow duct 28 and support 24 may be mounted directly to cyclonic cleaning stage 22.

Figure 5:
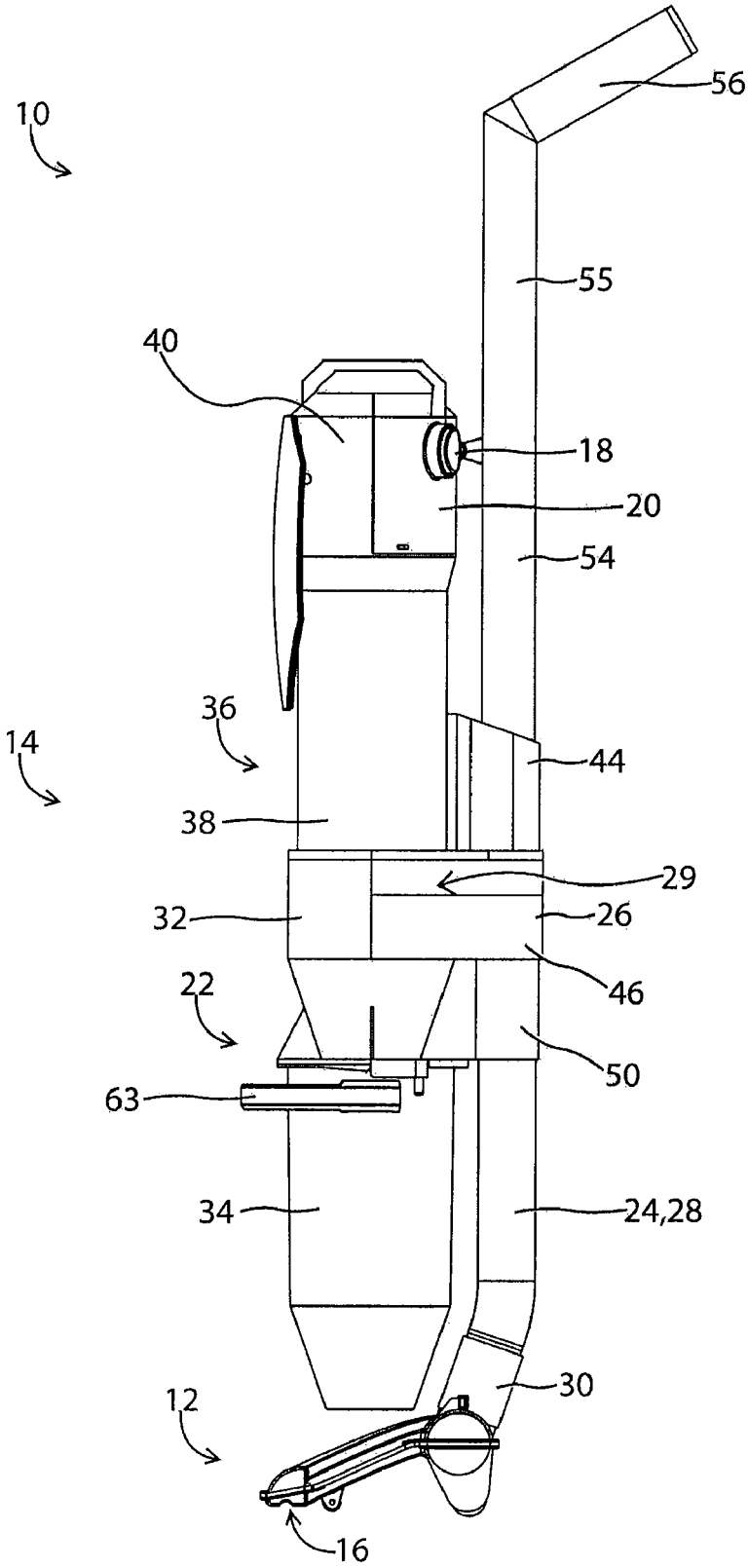
FIG. 5 is a side elevational view of the upright vacuum cleaner of FIG. 1.

In the embodiments shown, air passes from support 24, into mounting member 26, and from mounting member 26 into cleaning stage 22. In the embodiments shown, cleaning stage 22 is a single cyclonic cleaning stage 22, which is provided in cyclone housing 32 having a longitudinally extending outer surface. In some embodiments, housing 32 is transparent or translucent, such that a user may view the interior thereof. Air enters cyclonic cleaning stage 22 via inlet 23, which, in the embodiments shown is provided in an upper part of cyclonic cleaning stage 22. In some embodiments, prior to entering inlet 23, the air may be directed along the exterior of cyclonic cleaning stage 22, such that air enters cyclonic cleaning stage 22 in a tangential direction. For example, as can be seen in FIG. 5, mounting member 26 comprises a portion 29 extending along cyclonic cleaning stage 22. In alternate embodiments, wherein a mounting member is not provided, a portion of upflow duct 28 may extend externally along cyclonic cleaning stage 22 towards inlet 23. In cyclonic cleaning stage 22, dirt is separated from air, and passes through outlet 35 into dirt chamber 34, which is provided below cyclonic cleaning stage 18.

Figure 15:
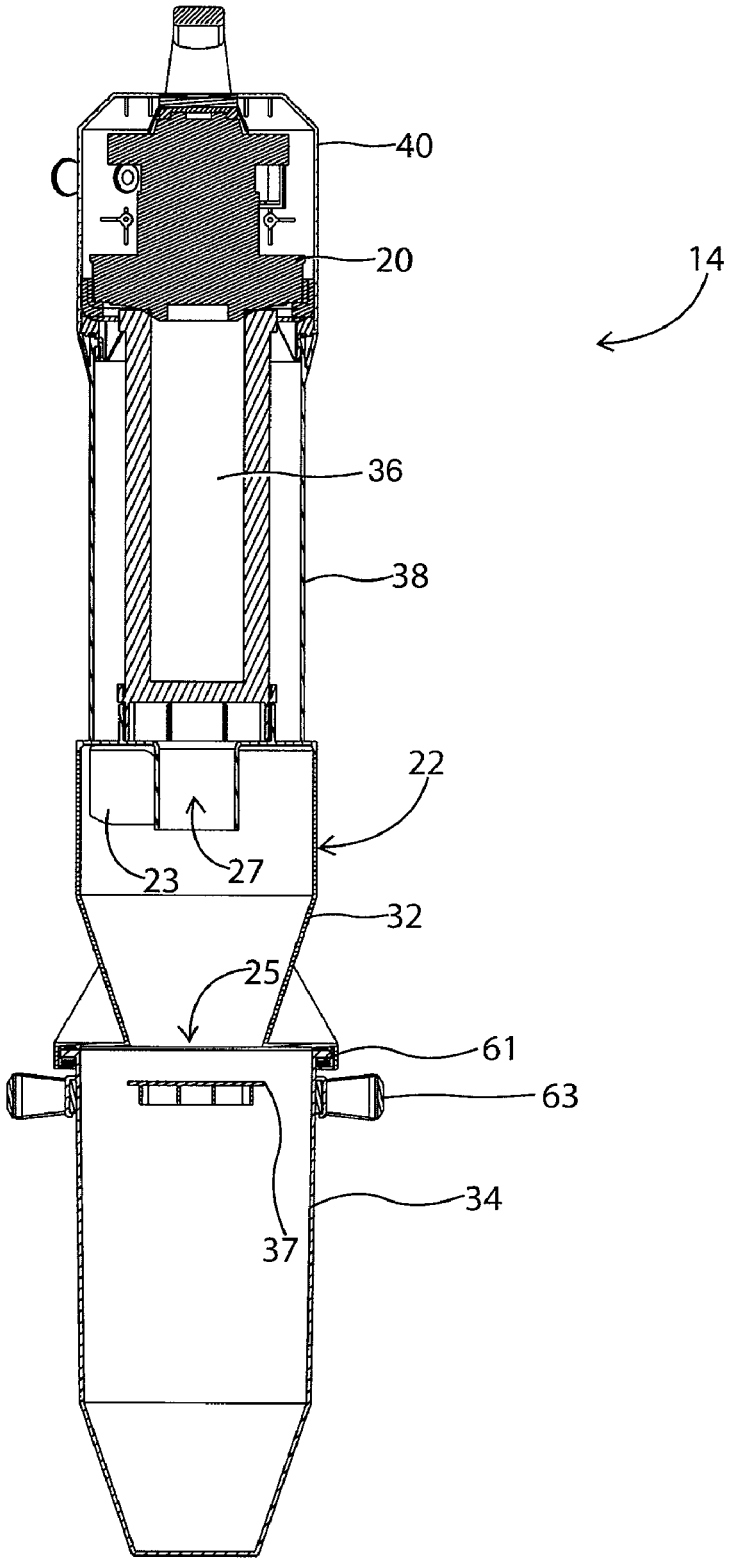
FIG. 15 is a longitudinal section through the upper casing of the vacuum cleaner of FIG. 13.

In some embodiments, a plate 37 may be positioned adjacent outlet 25. It will be appreciated that plate 37 may be positioned at any height in dirt chamber 34. Preferably, plate 37 is positioned proximate the top of dirt chamber 34 and proximate dirt outlet 25 from cyclone housing 32. Accordingly, as shown in FIG. 15, essentially the entire volume of dirt chamber 34 is available to function as dirt collection chamber 34. Preferably, plate 37 is positioned inwards from an inner wall of dirt collection chamber 34, except for the portion of the inner wall to which plate 37 may be attached, so as to define an annular gap between the outer wall of plate 37 and the inner wall of dirt chamber 34. Preferably, the minimum distance between plate 37 and cyclone housing 32 or dirt chamber 34, is at least as large as the largest dimension of the cyclone inlet 23. For example, if the cyclone inlet 23 has a 1 inch diameter, then the minimum distance between plate 37 and cyclone housing 32 or dirt chamber 34 is preferably is 1 inch or larger. An advantage of such a design is that any dirt particle that enters the cyclone housing 32 will be able to pass through the gap into dirt collection chamber 34. The distance between the top of plate 37 and the bottom of the cyclone housing may be 0.01-2.5 inches and is preferably at least the largest diameter of the cyclone inlet.

In some embodiments, the plate 37 may be removable with dirt chamber 34 from surface cleaning apparatus 10, as will be described further hereinbelow (see for example the embodiment of FIG. 6). An advantage of this design is that plate 37 defines a partial cover for the dirt collection chamber 34. Alternately, as shown in the embodiment of FIG. 7, plate 37 may remain in position when dirt chamber 34 is removed. In such an embodiment, plate 34 is preferably attached to the bottom of cyclone housing 32

Figure 17:
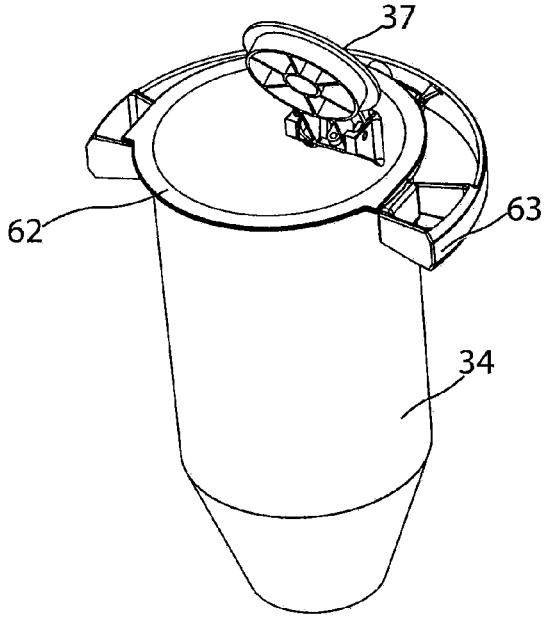
FIG. 17 is a top plan view of the dirt chamber of FIG. 13 with the separation plate shown in a raised position.
Figure 16:
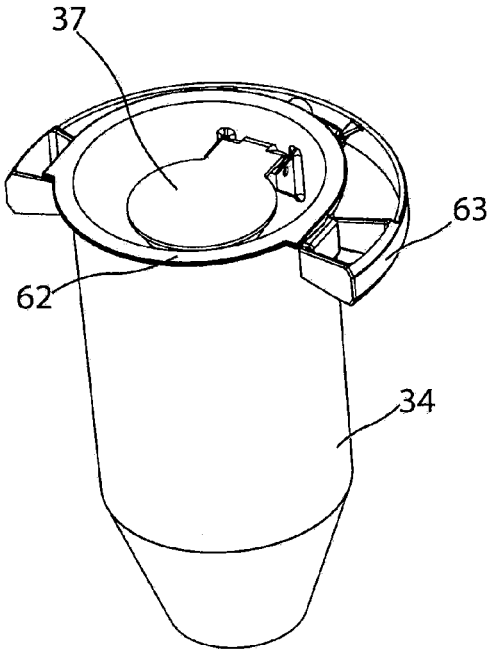
FIG. 16 is a top plan view of the dirt chamber of FIG. 13 with the separation plate shown in the horizontal position.

In a particularly preferred embodiment, as exemplified in FIGS. 16 and 17, plate 37 is pivotally mounted to the inner wall of cyclone chamber 34. Accordingly, plate 37 may be in the horizontal or closed position shown in FIG. 16 when surface cleaning apparatus 10 is in use and when dirt chamber 34 is removed from the vacuum cleaner. When dirt collection chamber 34 is inverted for emptying, plate 37 may pivot to an open position (as exemplified in FIG. 17) due to gravity. If plate 37 is pivotally mounted to the inner wall of chamber 34, then the annular gap is preferably at least one inch. Such a configuration permits plate 37 to pivot open to permit dirt to be emptied out of chamber 34 when chamber 34 is inverted.

Figure 18:
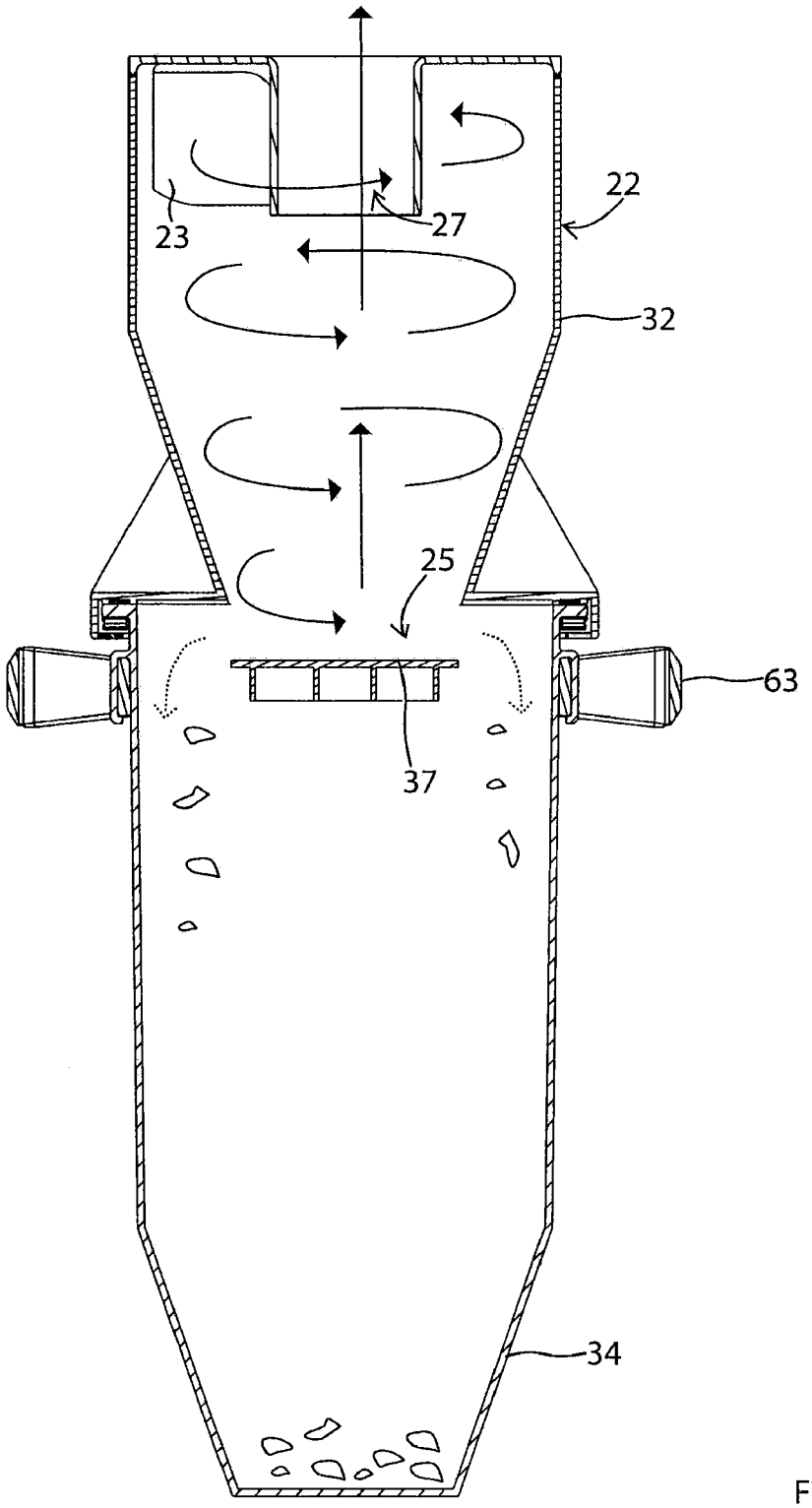
FIG. 18 is a cross section through the cyclone housing and dirt chamber shown in FIG. 15 with the air flow pattern shown therein.
Figure 19:
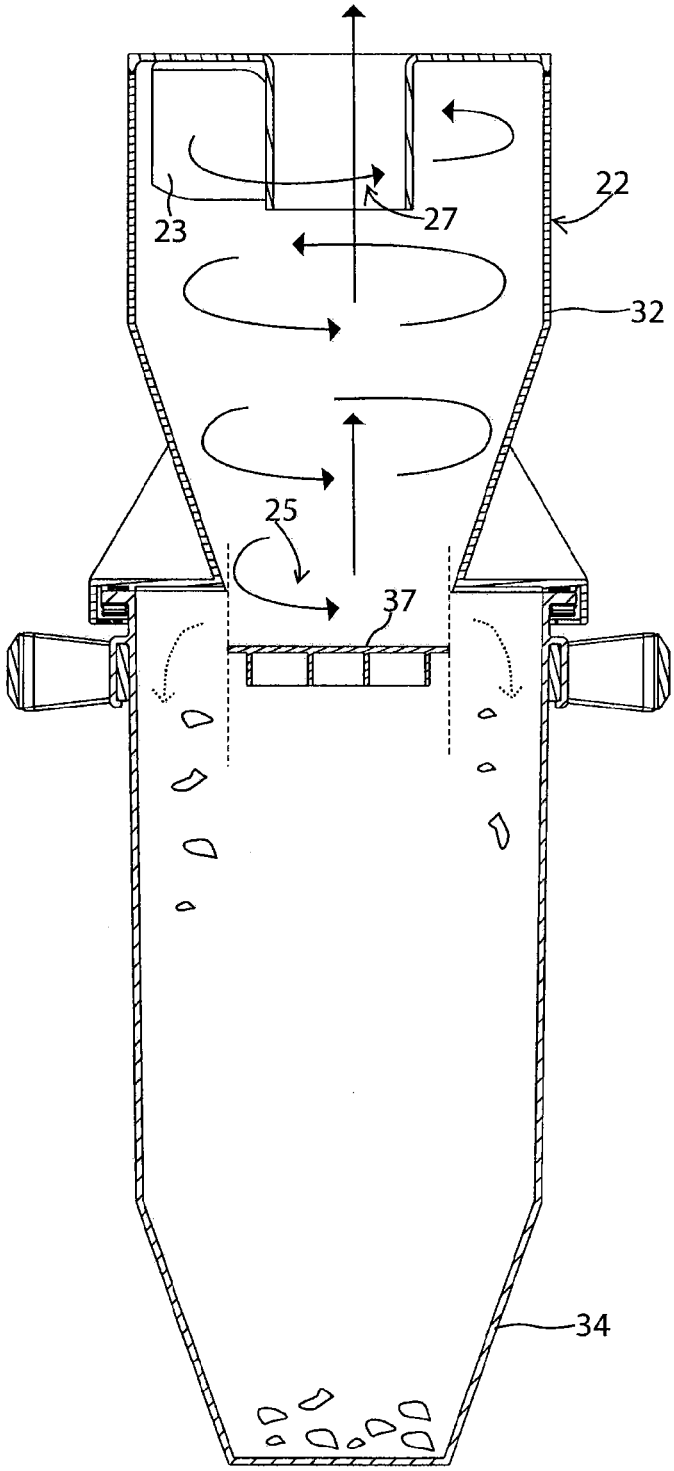
FIG. 19 is a cross section through an alternate cyclone housing and dirt chamber showing the air flow pattern therein.

In some embodiments, plate 37 may have the same diameter as the cyclone dirt outlet 25. Accordingly, if the cyclone housing 32 is cylindrical, then the diameter of plate 37 may be the same as the diameter of the cyclone. Alternately, a shown in FIG. 19, if the cyclone is conical, plate 37 may have the same diameter as the outlet 25 of cyclone housing 34. Alternately, plate 37 may have a larger diameter, as shown in FIG. 18. It will be appreciated that if the cyclone is conical, then plate 37 may have a diameter that is equal to the projected diameter of a end of the cone that is projected to the top of plate 37.

Referring back to FIGS. 1-5, surface cleaning apparatus 10 further comprises a filter assembly 36 provided downstream from cleaning stage 22. In the embodiments shown, filter assembly 36 is housed in filter housing 38. In alternate embodiments (not shown), filter assembly may be provided in the cyclone housing 32. From cyclonic cleaning stage 22, air passes out of outlet 27 upwardly and through filter assembly 36. The air exits filter assembly 36 and is directed to motor 20, which is housed in housing 40. In the embodiments shown, motor 20 is provided on upper section 14, adjacent and above filter assembly 36. In alternate embodiments, motor 20 may be provided in cleaning head 12. In either embodiment, motor 20 is provided downstream from the cleaning stage 22. Accordingly, a downflow duct may be provided between upper section 14 and surface cleaning head 12. In some embodiments, support member 24 may comprise the downflow duct. In other embodiments, the downflow duct may be a separate member.

In alternate embodiments, cleaning unit may be otherwise configured. For example, upper section 14 may comprise a second cleaning stage (not shown) positioned above cleaning stage 22 and including a plurality of cyclones in parallel. furthermore, in some embodiments, cleaning unit may comprise no filter assemblies, or more than one filter assembly.

As previously mentioned, in one optional aspect a mounting member 26 serves to provide a support to which operating components, preferably at least two operating components, of the upright surface cleaning apparatus are directly or indirectly mounted. In the preferred embodiment, one of the operating components comprises cleaning stage 22. In a further preferred embodiment, the other of the operating components comprises suction motor 20. Preferably, suction motor 20 and/or cleaning stage 22 are removably mounted to mounting member 26. In some embodiments, mounting member 26 further serves to connect upflow duct 28 in fluid communication with cyclonic cleaning stage 22. It will be appreciated that, in accordance with this aspect, any construction may be used for the operating components. For example, any cyclonic cleaning stage or stages and/or any filtration member known in the surface cleaning art may be used.

Figure 6:
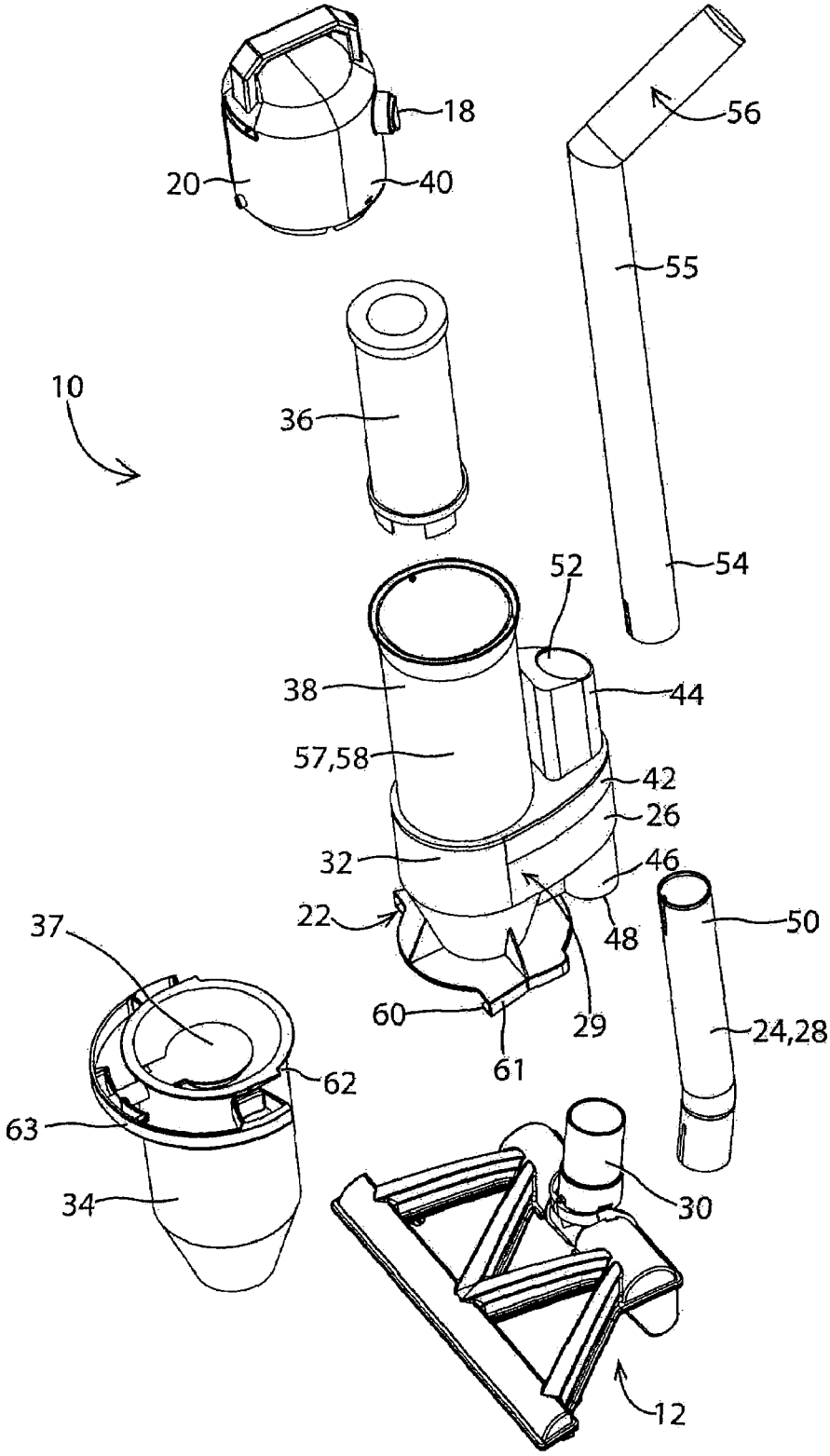
FIG. 6 is an exploded view of the upright vacuum cleaner of FIG. 1.
Figure 7:
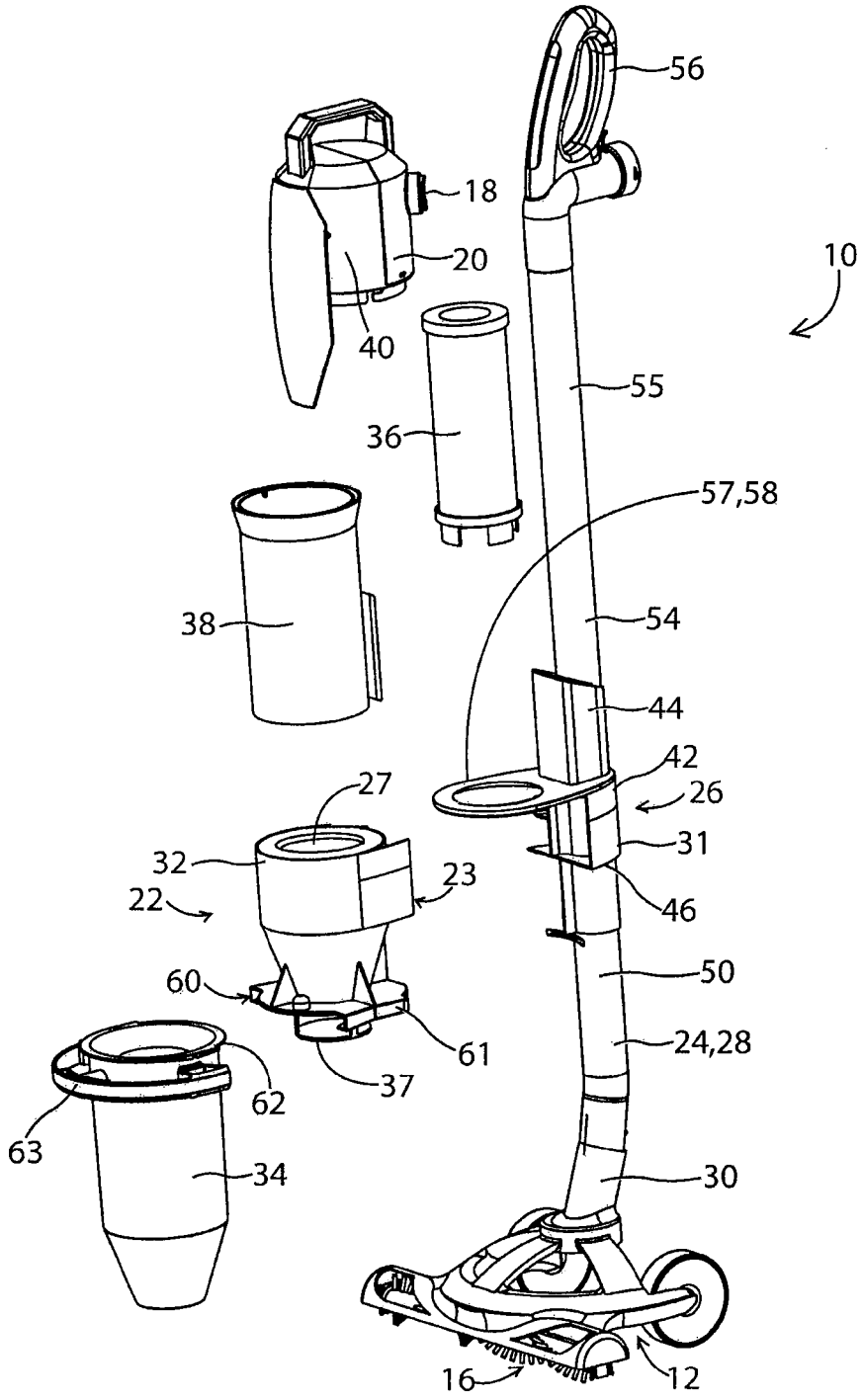
FIG. 7 is an exploded view of an alternate embodiment of the vacuum cleaner of FIG. 1.
Figure 8:
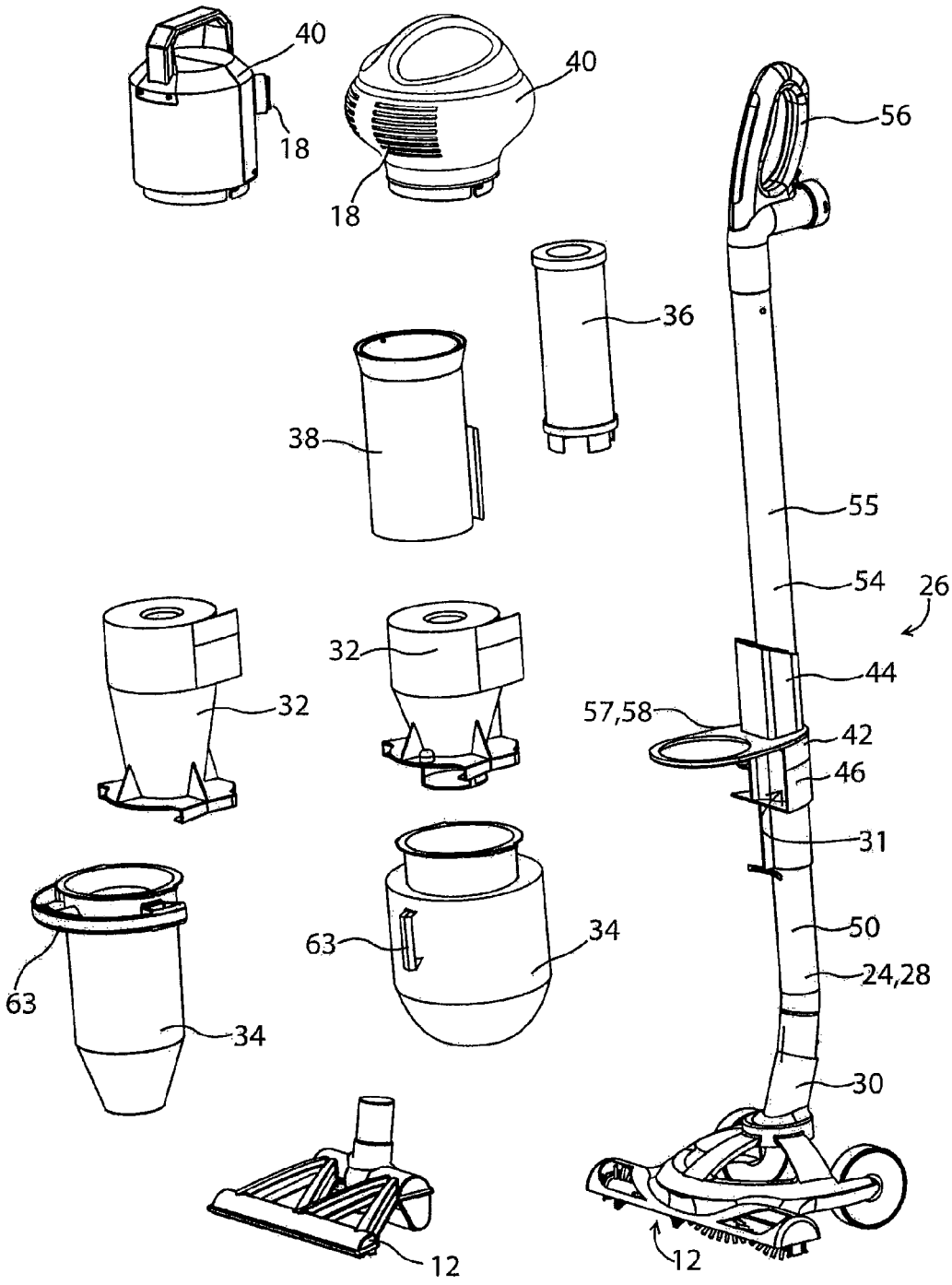
FIG. 8 is an exploded view showing a plurality of different components which are interchangeable and may be utilized to custom design different vacuum cleaners using common components.

Referring to FIGS. 6 and 7, in the embodiments shown, mounting member 26 comprises a body 42 having an upper portion 44 and a lower portion 46. Lower portion 46 defines an opening 48 for receiving an upper end 50 of support member 24. Upper end 50 of support member 24 may be securely mounted in opening 48 by any means, such as by an adhesive, a friction fit, a set screw or the like. In embodiments wherein support member 24 comprises upflow duct 28, opening 48 may be in fluid communication with a cyclone chamber inlet 23. In the embodiment shown, the upper portion 44 of mounting member 24 comprises a second opening 52. Second opening 52 receives a lower end 54 of a handle extension 55, which supports handle 56. Lower end 54 may be secured in second opening 52 by any means known in the art.

Mounting member 26 further comprises a portion 57 for receiving one or more operating components of surface cleaning apparatus 10. For example, as shown in FIG. 7, mounting member 26 is provided with a securing ring 58. Securing ring 58 provides a member to which one or more operating components may be mounted, preferably removably mounted. For example, in the embodiments shown in FIGS. 1-14, upper section 14 may be assembled by positioning filter housing 38 above securing ring 58, and positioning cleaning stage housing 32 below ring 58. Filter housing 38 and cleaning stage housing 32 may then be secured together, preferably removably secured together, for example by using screws, a bayonet mount, or a screw thread. In alternate embodiments, filter housing 38 and cleaning stage 32 may be permanently secured together, for example by using an adhesive or welding.

Motor housing 40 may then be mounted to filter housing 38, for example by using by using screws, a bayonet mount, a screw thread, or an adhesive or welding. Preferably motor housing 40 is removably mounted to filter housing 38. Additionally, dirt chamber 34 may be mounted, preferably removably mounted, to cleaning stage 22. Accordingly, in this embodiment, the first cleaning stage 22 is directly mounted to mounting member 26, and motor 20 is indirectly mounted to mounting member 26.

In other embodiments, operating components of surface cleaning apparatus 10 may be mounted to mounting member 26 in another manner. For example, in one embodiment (not shown), mounting member 26 may comprise a bracket to which filter housing 38 may be mounted, for example by using screws. Cleaning stage housing 32 may then be mounted to filter housing, without contacting mounting member 26. Dirt chamber 34 may then be mounted to cleaning stage housing 32, and motor housing 40 may be mounted above filter housing 38. Accordingly, in this embodiment, both of first cleaning stage 22 and motor 20 are indirectly mounted to mounting member 26.

In another embodiment (not shown), motor housing 40 may be positioned above securing ring 58, and filter housing 38 may be positioned below securing ring 58, and motor housing 40 and filter housing 38 may be secured together, for example using screws. Cleaning stage housing 32 may then be mounted below filter housing 38, for example using screws, and dirt chamber 34 may be mounted below dirt chamber 34. Accordingly, in this embodiment, motor 20 is directly mounted to mounting member 26, and cleaning stage housing 22 is indirectly mounted to mounting member 26. In other embodiments, as previously mentioned, motor 20 may be provided on surface cleaning head 12. Accordingly, in such embodiments, motor 20 may not be mounted to mounting member 26 at all.

In yet another embodiment, a second cleaning stage (not shown) may be provided, and may be positioned above securing ring 58. First cleaning stage 22 may be positioned below securing ring 58, and may be secured to the second cleaning stage.

It will be appreciated that, in alternate embodiments, upper section 14 may have the units arranged in a different order. For example, motor housing 40 need not be provided on top of filtration housing 38. Instead, motor housing 40 could be provided beneath dirt chamber 34.

In the above embodiments, dirt chamber 34 is preferably removably mounted to cleaning stage 22, such that a user may empty dirt chamber 34. For example, referring to FIGS. 13 and 14, cleaning stage housing 32 comprises flanges 61 at a lower end thereof which provide slots 60. Dirt chamber 34 comprises a rim 62, which may be slidably received in slots 60. Dirt chamber 34 further comprises a handle 63, for gripping dirt chamber 34. In some embodiments, plate 37 may be removable with dirt chamber 34 from surface cleaning apparatus 10 (see for example the embodiment of FIG. 6). An advantage of this design is that plate 37 defines a partial cover for the dirt collection chamber. Alternately, as shown in the embodiment of FIG. 7, plate 37 may remain in position when dirt chamber 34 is removed.

One advantage of the embodiments described above is that the volume of the upright vacuum cleaner may be reduced. In particular, in the embodiments shown, a housing is not provided for receiving upper section 14. That is, the outer surfaces of one or more of cleaning stage 22, motor housing 40, filter housing 38, and dirt chamber 34 may be visible when surface cleaning apparatus is in use (except for the portions facing support member 24, handle extension 55, and/or the upflow duct). Accordingly, the overall volume of the vacuum cleaner is reduced. In addition, the weight of the vacuum cleaner is also substantially reduced. In particular, the amount of plastic that is typically used to construct an upper casing of a cyclonic vacuum cleaner that receives a removable cyclone chamber or dirt chamber substantially increases the weight of the vacuum cleaner. In the embodiments shown, surface cleaning apparatus 10 may weigh 10 lbs. or less (without the cord) and, preferably less than 8 lbs.

A further advantage of the embodiments shown is that, if the elements of upper section 14 are removably mounted to each other and to mounting member 26, the upper section 14 may be easily disassembled for cleaning. In addition, if a component needs to be replaced, the user may merely acquire the required component (e.g. by purchasing it at a store or on line) and replace the faulty component. For example, if motor 20 fails, pursuant to a warranty plan, the manufacturer may merely ship the required motor housing 40 and motor 20 to the customer who may remove (e.g., unscrew) the motor housing 40 having the faulty suction motor 20 and replace it with the new replacement part.

A further advantage of this design is that filter assembly 36 may be accessed for removal (for cleaning or replacement) by disassembling a portion of upper section 14. For example, in the embodiments of FIGS. 6 and 7, filter assembly 36 may be accessed by removing motor housing 40 from upper section 14. Accordingly, a door or the like is not required in filter housing 38, thereby simplifying the construction of filter housing 38.

A further advantage of this modular construction is that alternate vacuum cleaners may be created by selecting alternate components for upper section 14 and/or alternate surface cleaning heads 12. For example, referring to FIG. 8, a plurality of upright vacuum cleaners may be designed by utilizing alternate motor housings 40, 40', cleaning stage housings 32, 32', dirt chambers 34, 34', and surface cleaning heads 12, 12'.

Figure 9:
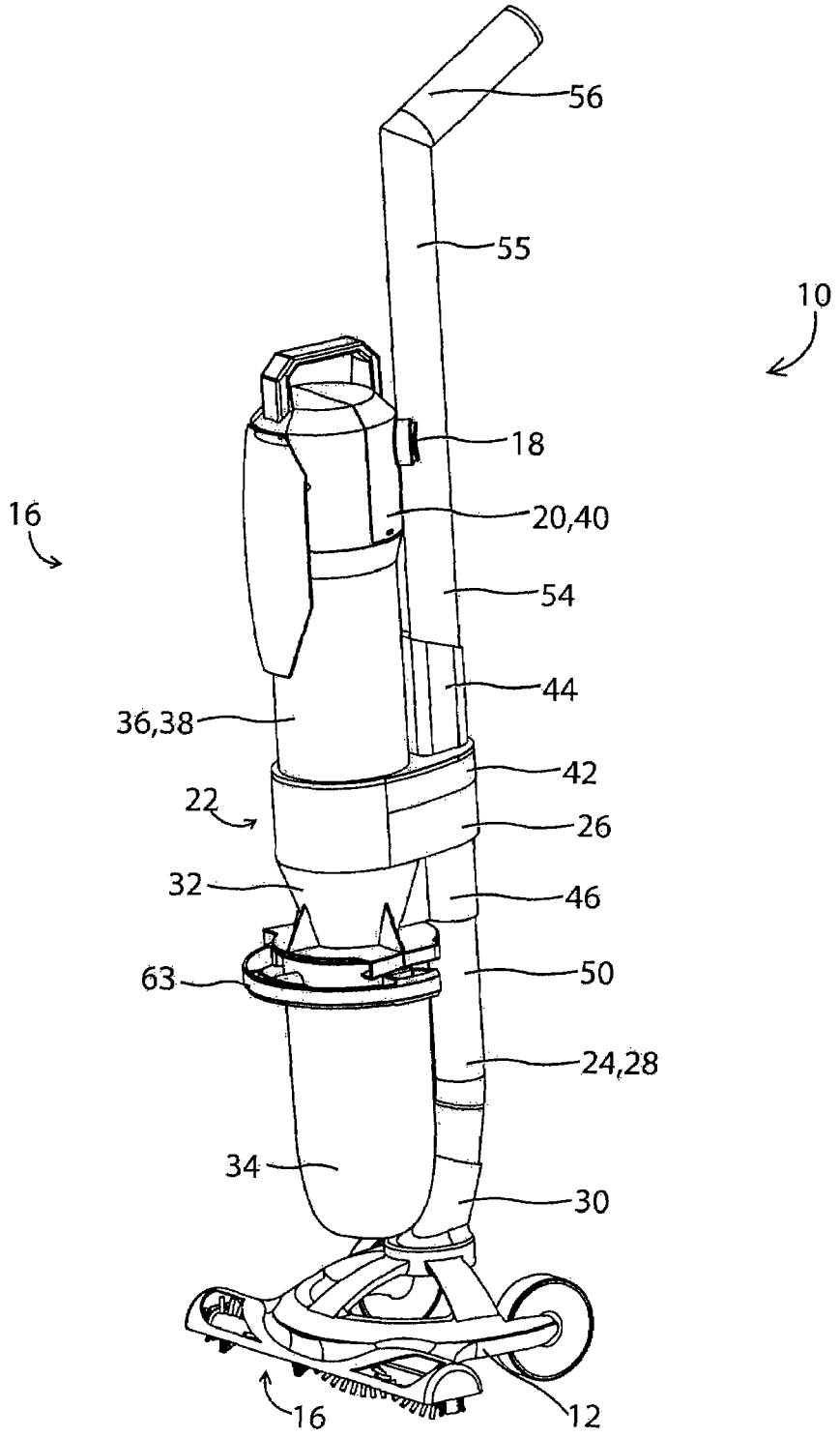
FIG. 9 is a perspective view of an alternate embodiment of a vacuum cleaner which may be constructed using the components of FIG. 8.
Figure 10:
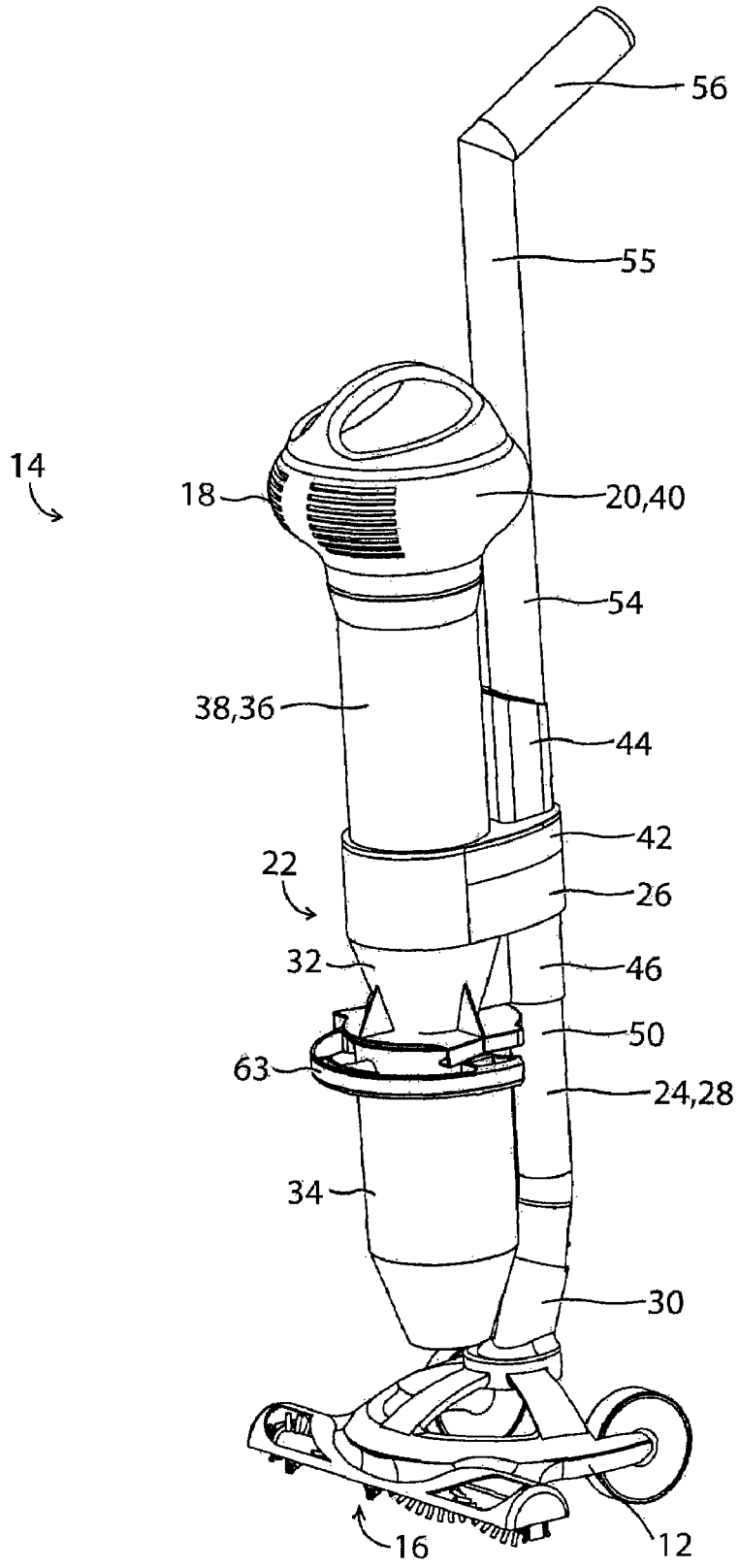
FIG. 10 is a further alternate embodiment of a vacuum cleaner which may be constructed using the components of FIG. 8.

In some embodiments, a plurality of different motor casings 40, cleaning stage housings 32, dirt chambers 34, and cleaning heads 12 are provided. In addition, a plurality of handles 56 may be provided. Accordingly, a plurality of vacuum cleaners having a different appearance may be prepared by selecting particular components. For example, as shown in FIG. 9, surface cleaning apparatus 10 utilizes the same components as the vacuum cleaner of FIG. 1 except that a different dirt chamber 34 and a different surface cleaning head 12 are utilized. Accordingly, surface cleaning apparatus 10 has a different appearance. Similarly, with respect to FIG. 10, a different motor housing 40 and surface cleaning head 12 are utilized to create a vacuum cleaner of a different appearance to that of FIG. 1.

Figure 11:
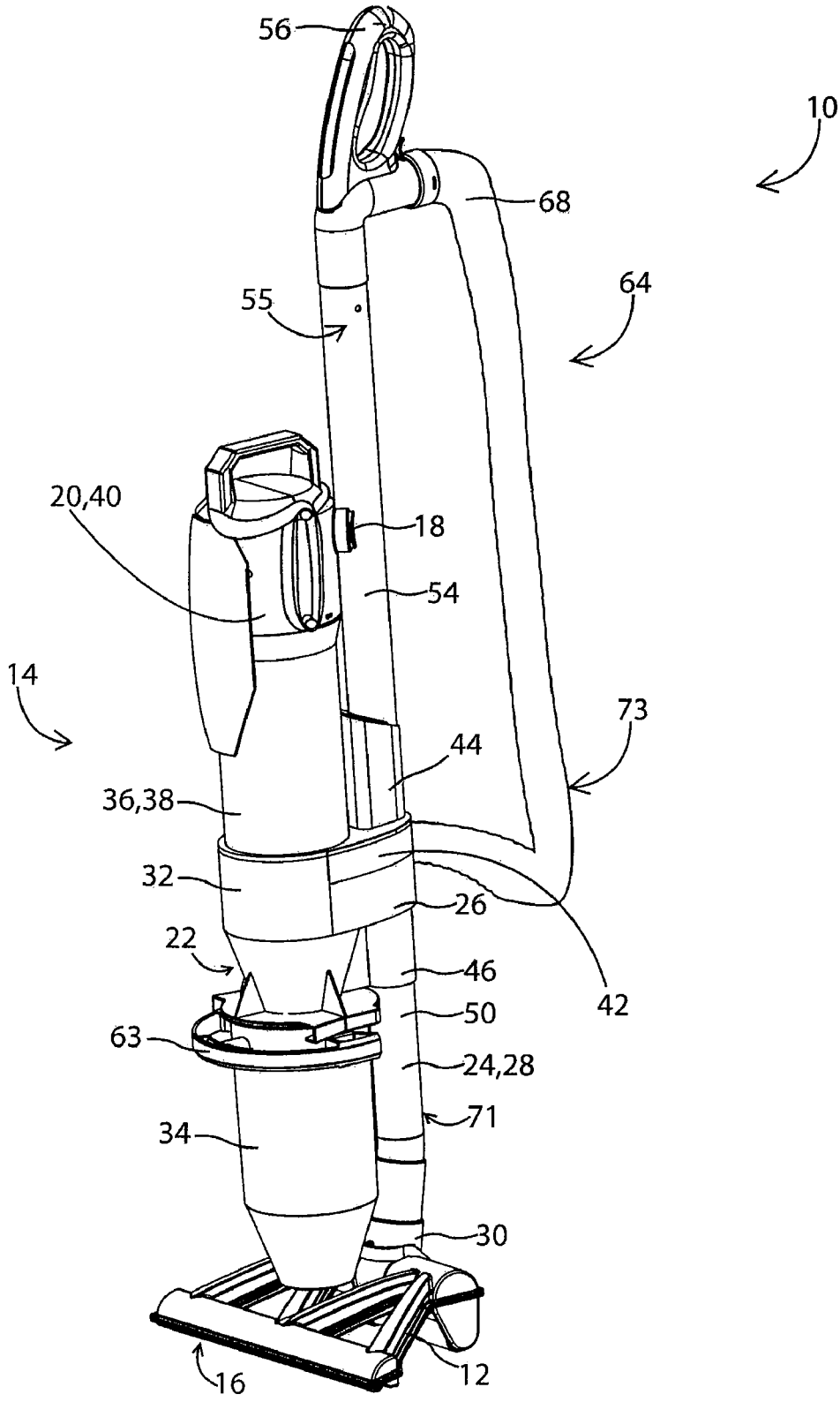
FIG. 11 is a further alternate embodiment of a vacuum cleaner which may be constructed using the components of FIG. 8.
Figure 12:
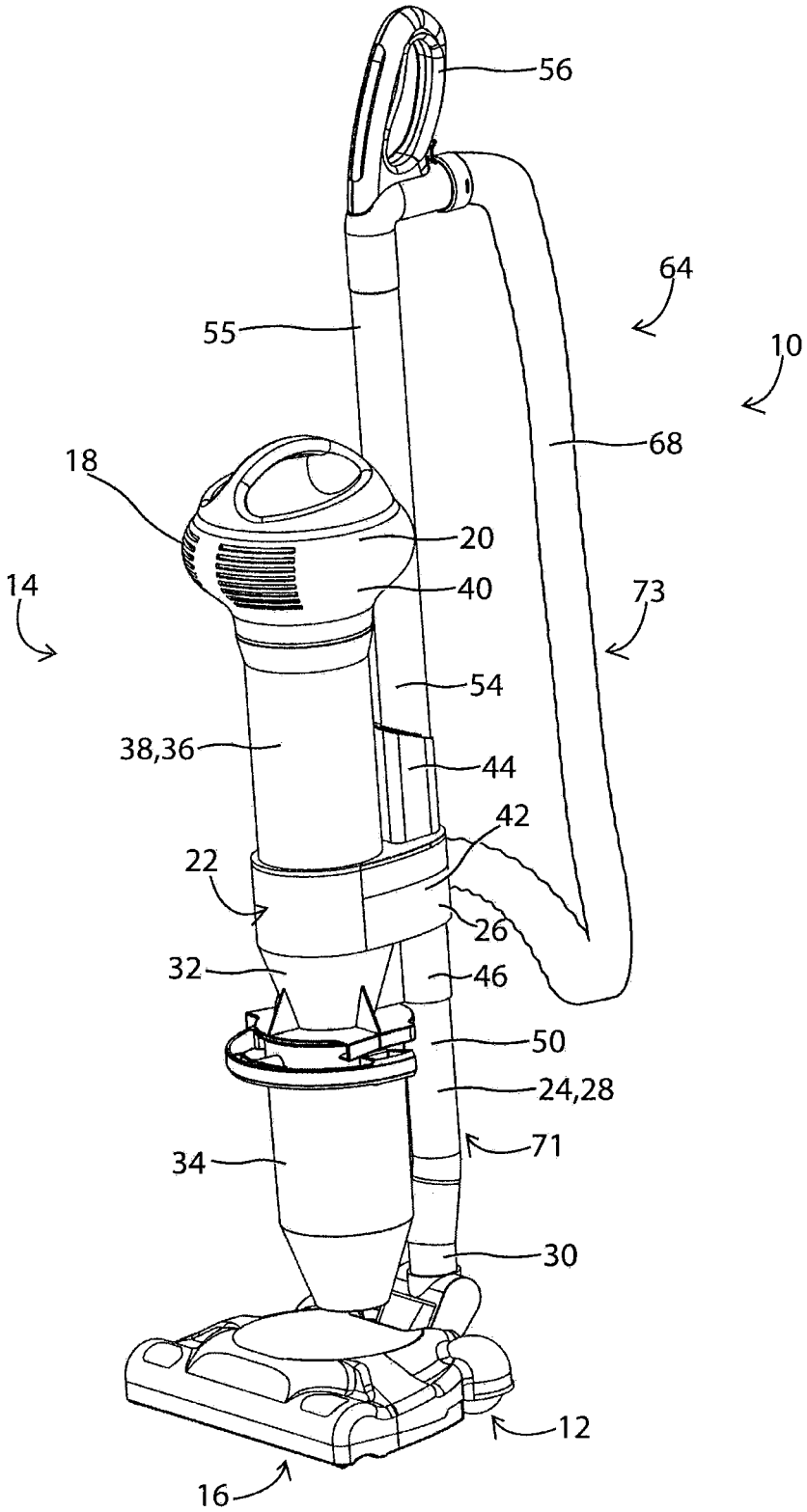
FIG. 12 is a further alternate embodiment of a vacuum cleaner which may be constructed using the components of FIG. 8.
Figure 13:
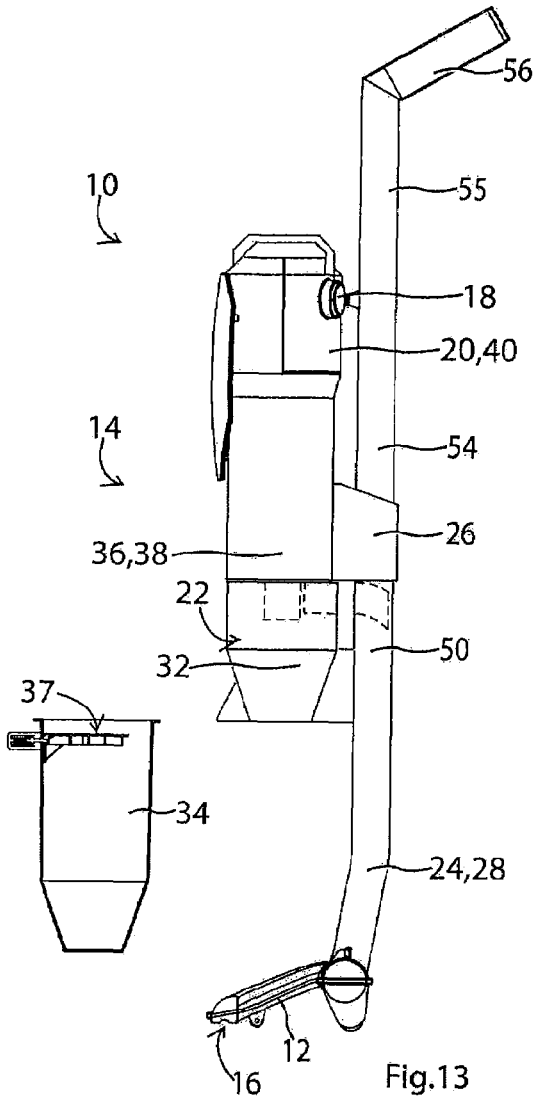
FIG. 13 is a side elevational view of the vacuum cleaner of FIG. 1 wherein the dirt chamber is slidably mountable on the cyclone housing and separately removable from the vacuum cleaner.
Figure 14:
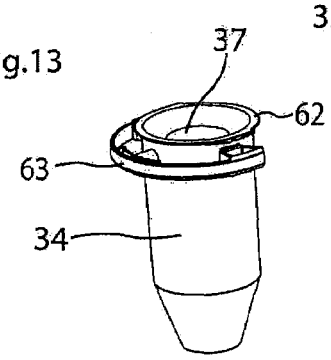
FIG. 14 is a perspective view of FIG. 13.
Figure 14:
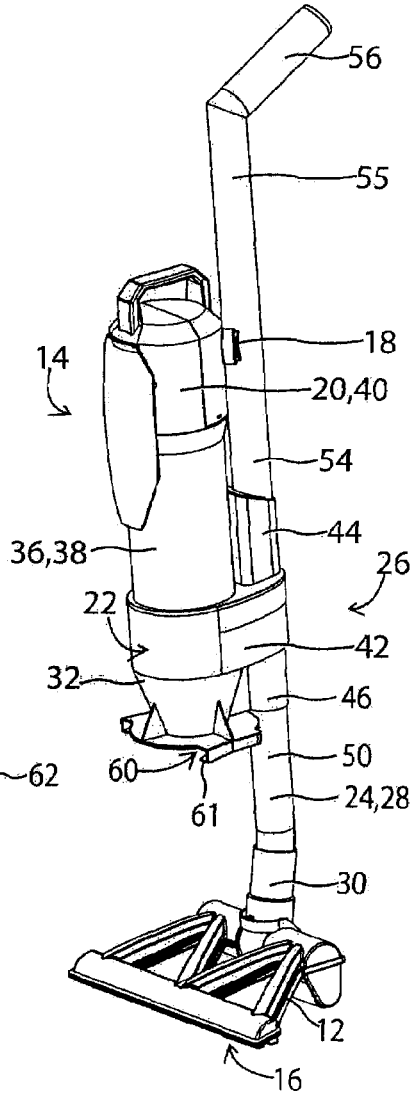

In accordance with another aspect of this invention, which may be use by itself or with any other aspect, an above floor cleaning assembly 64 is provided (see for example FIG. 11). In this embodiment, surface cleaning apparatus 10 comprises first 16 and second 17 (shown in FIG. 28) dirty fluid inlets, which are selectively connectable in fluid flow communication with cleaning stage 22. Surface cleaning apparatus 10 may be converted from a floor cleaning mode (FIGS. 25 and 26) to an above floor cleaning mode (FIGS. 27, and 28) by rotating an airflow valve 66 provided in mounting member 26. In the floor cleaning mode, valve 66 connects upflow duct 28 to cyclone inlet 23 such that air travels from first dirty fluid inlet 16 in surface cleaning head 12 to cyclone inlet 23. When valve 66 is rotated to the other position, and handle extension 55 is removed from mounting member 26, air travels from second dirty fluid inlet 17 through handle extension 55, to flexible hose 68, and past valve 66 to cyclone inlet 23. Accordingly, in this embodiment, the first 16 and second 17 dirty fluid inlets are respectively in flow communication with first 71 and second 73 airflow passages, which merge at a position proximate the inlet of the first cyclonic cleaning stage 22. One advantage of this design is that a simplified structure for converting a surface cleaning apparatus 10 to an above cleaning mode is provided. In addition, as valve 66 is provided in mounting member 26, and therefore a few feet above the floor, then a user need not bend down to rotate valve 66 between the floor cleaning position and the above floor cleaning position. In other embodiments, valve 66 may be affixed to the handle 56 or support member 24.

Figure 29:
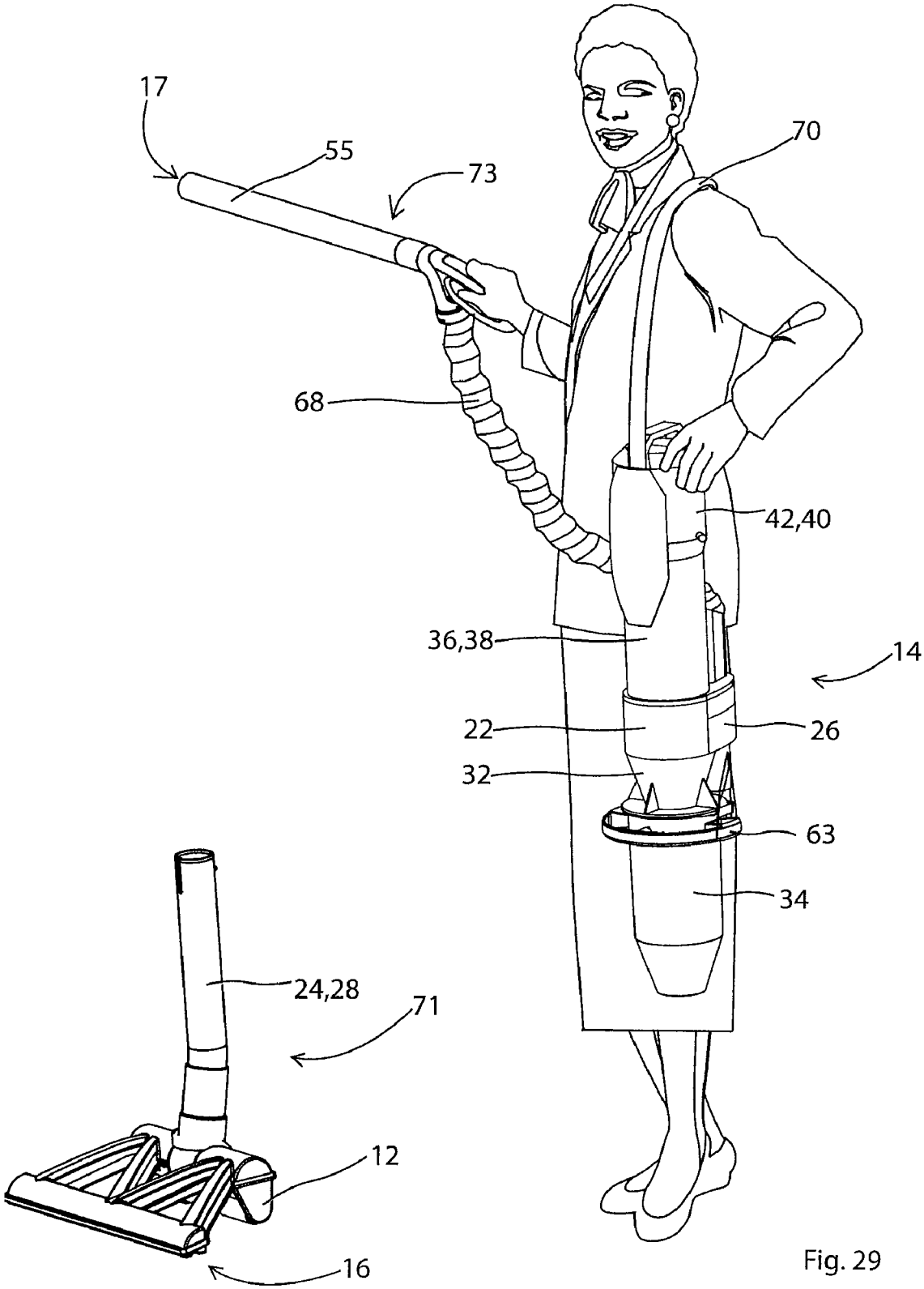
FIG. 29 is a perspective view of a vacuum cleaner in accordance with another embodiment of the instant invention having a shoulder strap and wherein the upper section has been removed from the cleaning head and handle extension and is used in the above floor-cleaning mode.

In accordance with another aspect of this invention, which may be used by itself or with any other aspect or aspects, surface cleaning apparatus 10 is convertible to a portable surface cleaning apparatus. That is upper section 14 is convertible to a portable cleaning and suction unit. Referring to FIG. 29, surface cleaning apparatus 10 is provided with a shoulder strap 70. In order to convert the surface cleaning apparatus 10 to a portable surface cleaning apparatus, the user may unwind shoulder strap 70 and extend it across their shoulder. Upper section 14, including mounting member 26, may be removed from support member 24 by, for example, actuating a release catch which secures handle 56 in opening 52, and lifting upper section 12 off of support member 24 using a handle on top of motor housing 40. Accordingly, upper section 14 is converted to a portable cleaning and suction unit 14.

Figure 20:
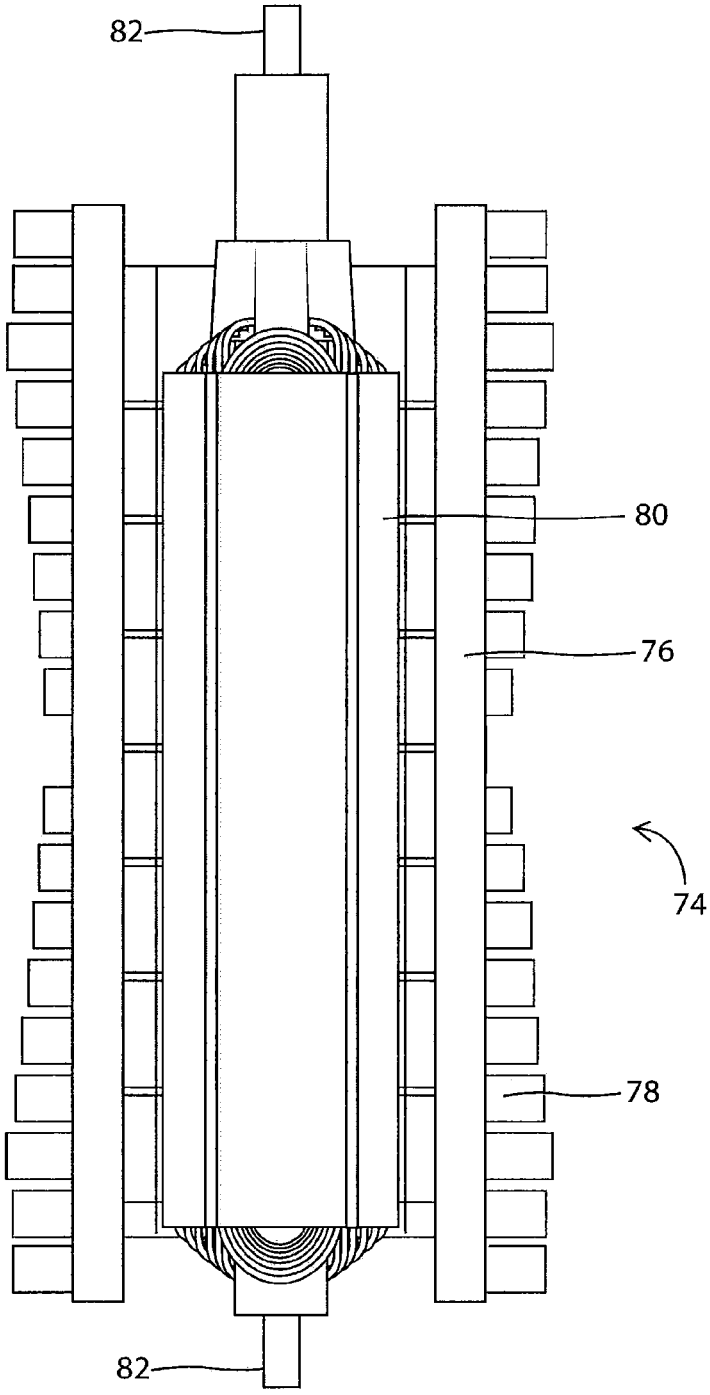
FIG. 20 is a partial longitudinal sectional view through a rotatably mounted brush for a surface cleaning head wherein the brush drive motor is mounted internally inside the rotatably mounted brush.

In any of the above embodiments, as exemplified in FIG. 20, surface-cleaning head 12 includes a rotatably mounted brush 74. Rotatably mounted brush 74 includes a central hub 76 with a plurality of bristles 78 extending outwardly therefrom. In accordance with this aspect, it is preferred that central hub 76 is at least sufficiently hollow to receive brush drive motor 80 therein. Accordingly, if brush drive motor is non-rotatably mounted in central hub 76, and if axles 82 are rotatably mounted in bearings in surface cleaning head 12, then when brush drive motor 80 is engaged, the rotation of brush drive motor 80 will cause brush 74 to rotate. Brush drive motor may be non-rotatably mounted in hub 76 by, e.g., a friction fit, a set screw or an adhesive.

In some embodiments, the vacuum cleaner may be reconfigurable to adapt the vacuum cleaner to collect a different types of particulate matter. For example, it may be desirable to utilize the vacuum cleaner to collect dry wall dust. Accordingly, the vacuum cleaner may be reconfigurable in one of several ways. Referring to FIGS. 22*a*-22*d*, according to one option, lever 84 is drivingly connected to plate 37 so as to adjust the position of plate 37 with respect to outlet 25. Accordingly, if the vacuum cleaner is to be utilized to collect standard household dust including dog hair, then the lever 84 may be moved to a first position, which is better suited for collecting such material. However, if the vacuum cleaner is then going to be used to collect, for example, dry wall dust, the lever 84 may be used to a second position wherein plate 37 is at a distance from outlet 25 that is more suited for the collection of dry wall dust. In a particularly preferred embodiment, a scale or labeled positions may be provided on the outer surface of housing 32 to indicate the preferred position of lever 84 for different types of dust. Accordingly, in order to reconfigure surface cleaning apparatus 10 for a particular type of dirt, a user may merely move lever 84 to a pre-marked position. It will be appreciated that lever 84 may operate in a variety of ways, each of which is within the scope of this description. For example, lever 84 may be slidably mounted in a vertical direction so that as lever 84 is moved upwardly or downwardly, plate 37 is also moved upwardly or downwardly. Alternately, a gear or crank mechanism may be utilized such that as lever 84 is moved sideways or rotated, the height of plate 37 is adjusted.

Figure 22A:
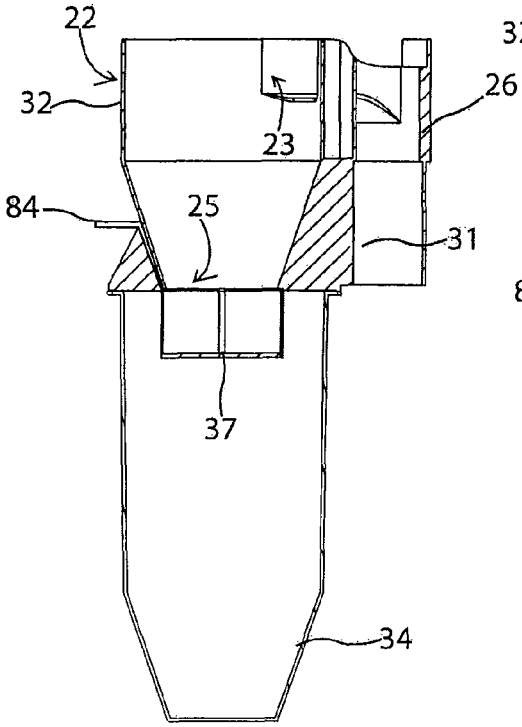
FIG. 22*a* is a cross section through an alternate cyclone housing and dirt chamber showing an adjustable height plate at a first position.
Figure 22B:
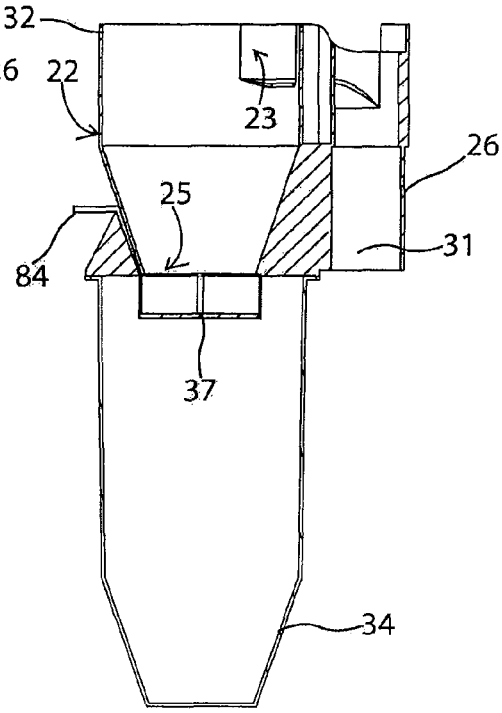
FIG. 22*b* is a cross section through the same cyclone housing and dirt chamber as in FIG. 22*a* wherein the plate has been adjusted to be closer to the dirt outlet of the cyclone.
Figure 22C:
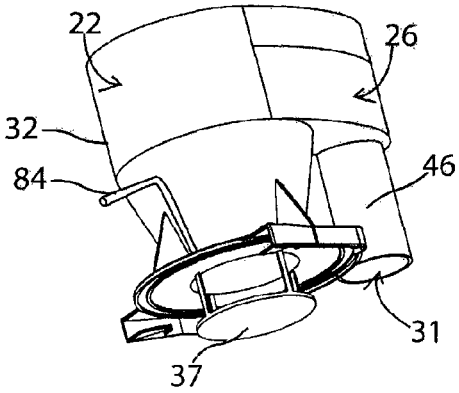
FIG. 22*c* is a perspective view of the cyclone housing of FIG. 25*a* with the cyclone chamber removed.
Figure 22D:
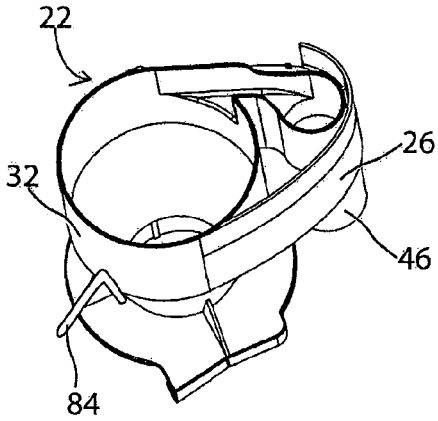
FIG. 22*d* is a perspective view from above of the cyclone housing of FIG. 22*c;*
Figure 22E:
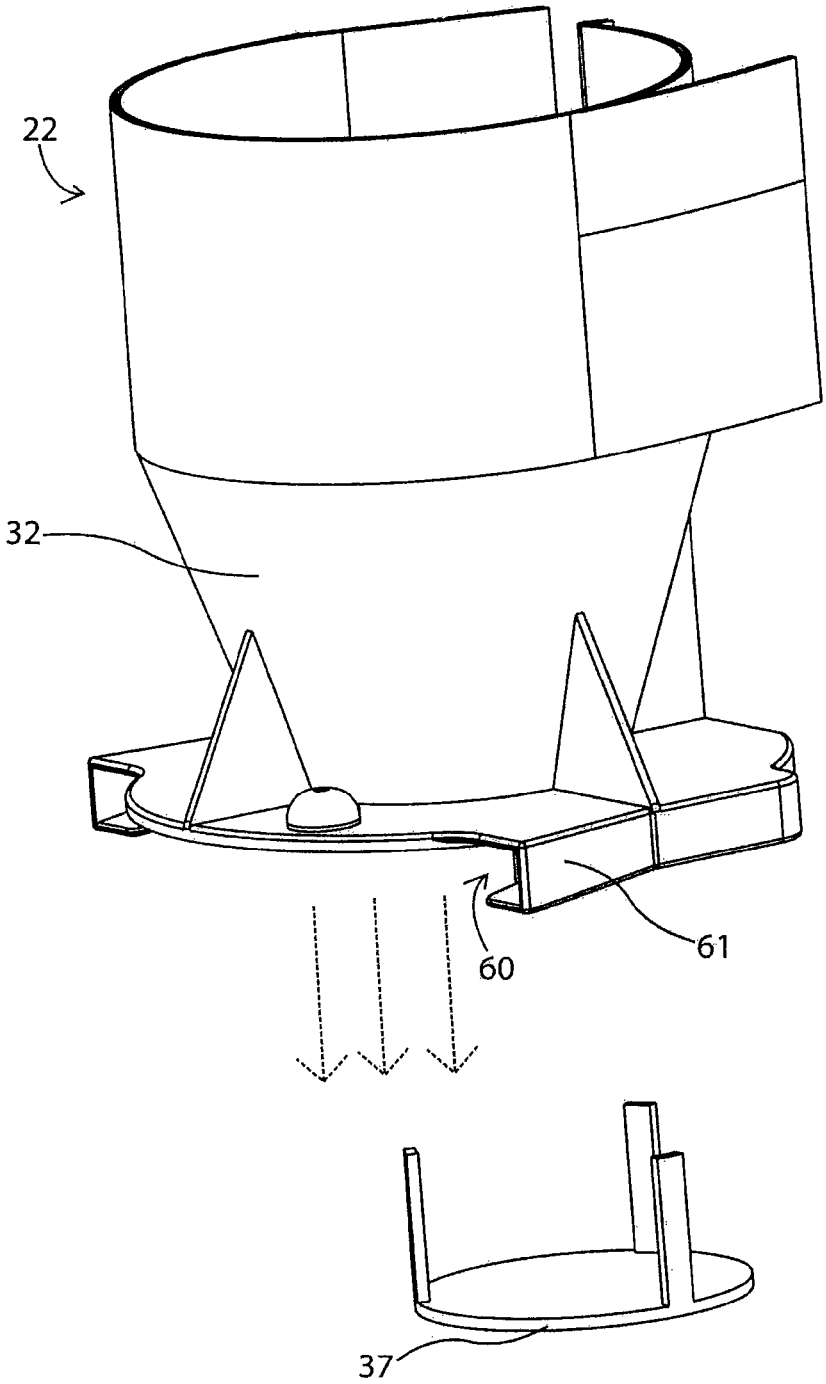
FIG. 22*e* is a perspective view of the cyclone housing of FIG. 25 with the separation plate removed.
Figure 23:
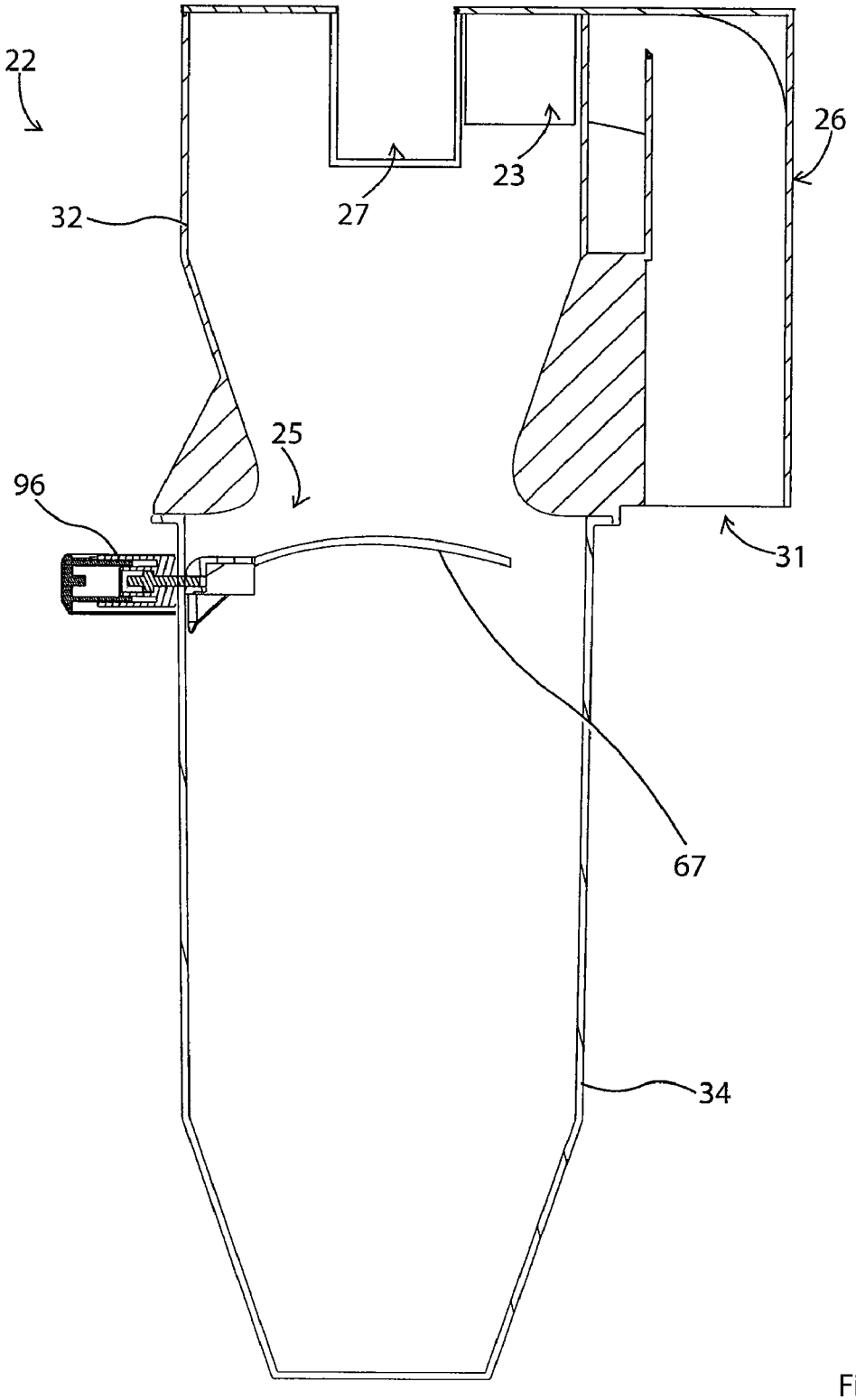
FIG. 23 is a cross section through an alternate cyclone housing and dirt chamber wherein the configuration of the plate is adjustable.
Figure 24:
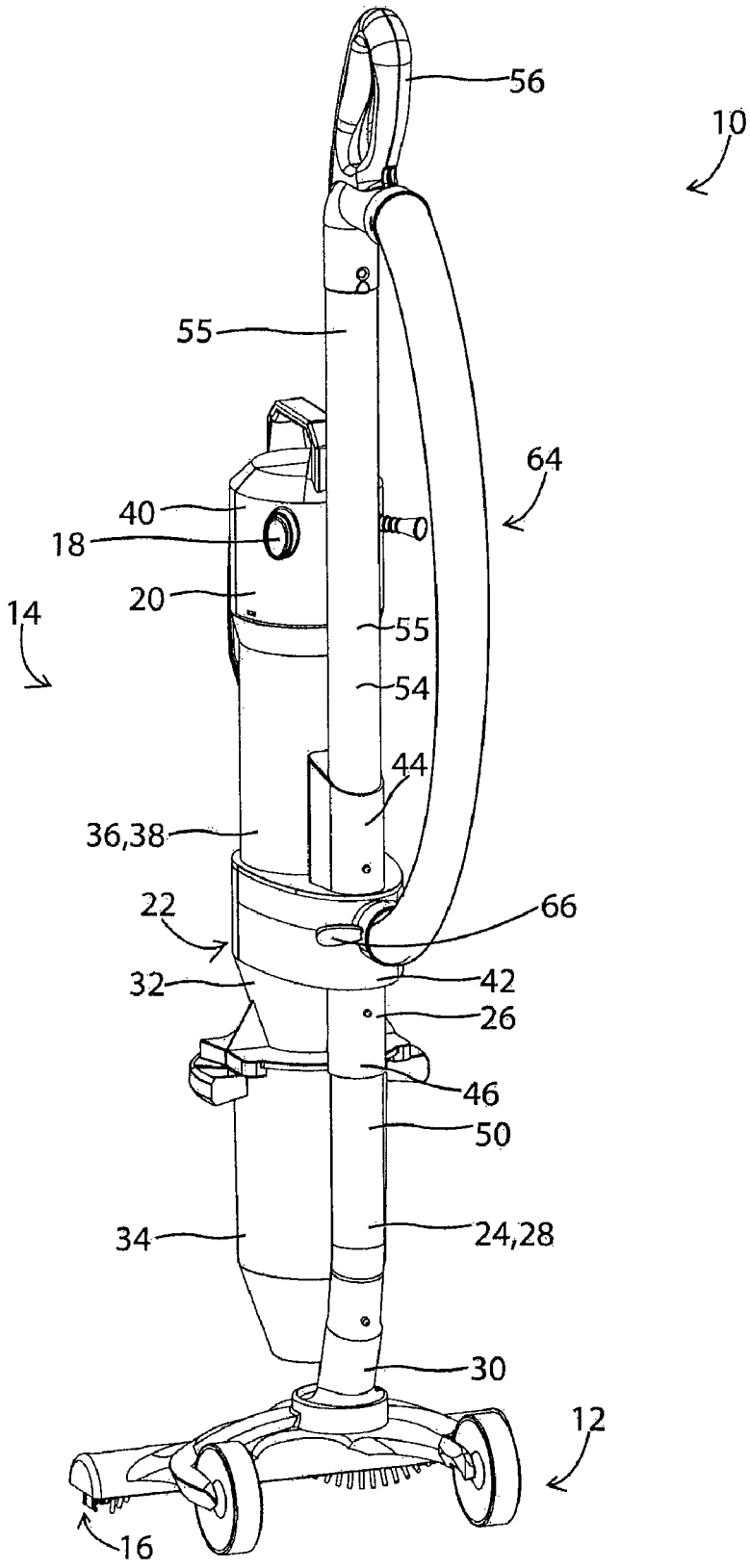
FIG. 24 is a perspective view of an upright vacuum cleaner in accordance with a further alternate embodiment of the instant invention wherein a valve is provided for adjusting the vacuum cleaner from a floor cleaning mode to above floor cleaning mode.
Figure 25:
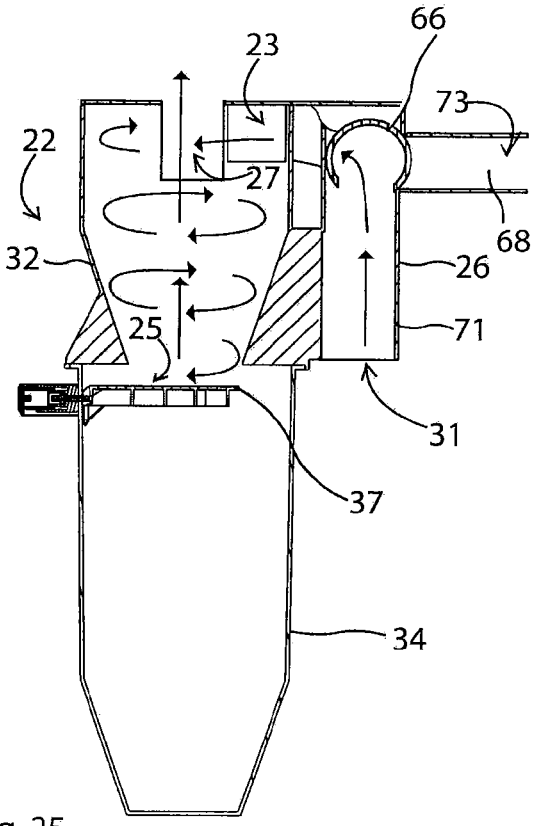
FIG. 25 is a cross section through the cyclone housing and dirt chamber of the vacuum cleaner of FIG. 24 wherein the vacuum cleaner is in the floor cleaning mode.
Figure 26:
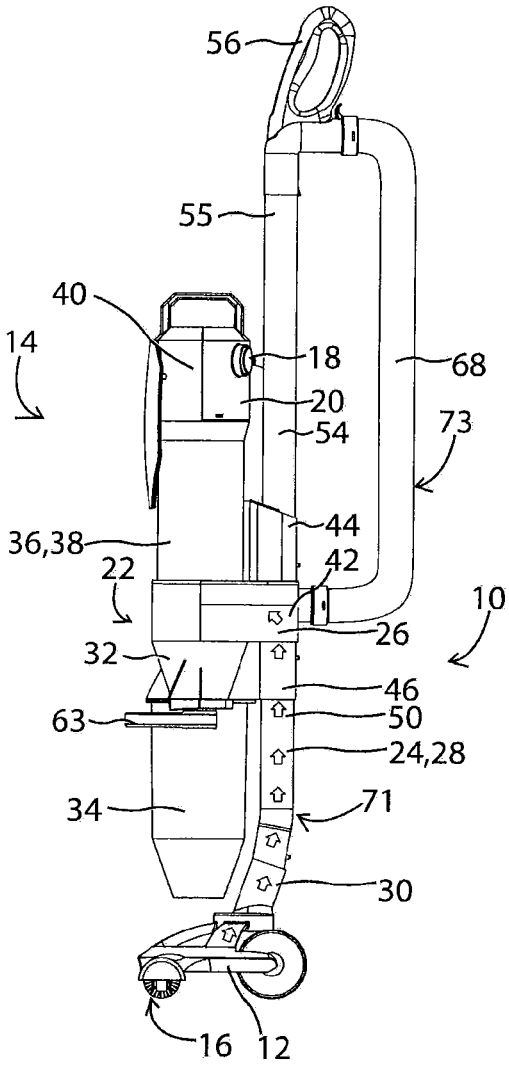
FIG. 26 is a side elevational view of the vacuum cleaner of FIG. 25 in partial section showing the air flow from the surface cleaning head to the cyclone inlet.
Figure 28:
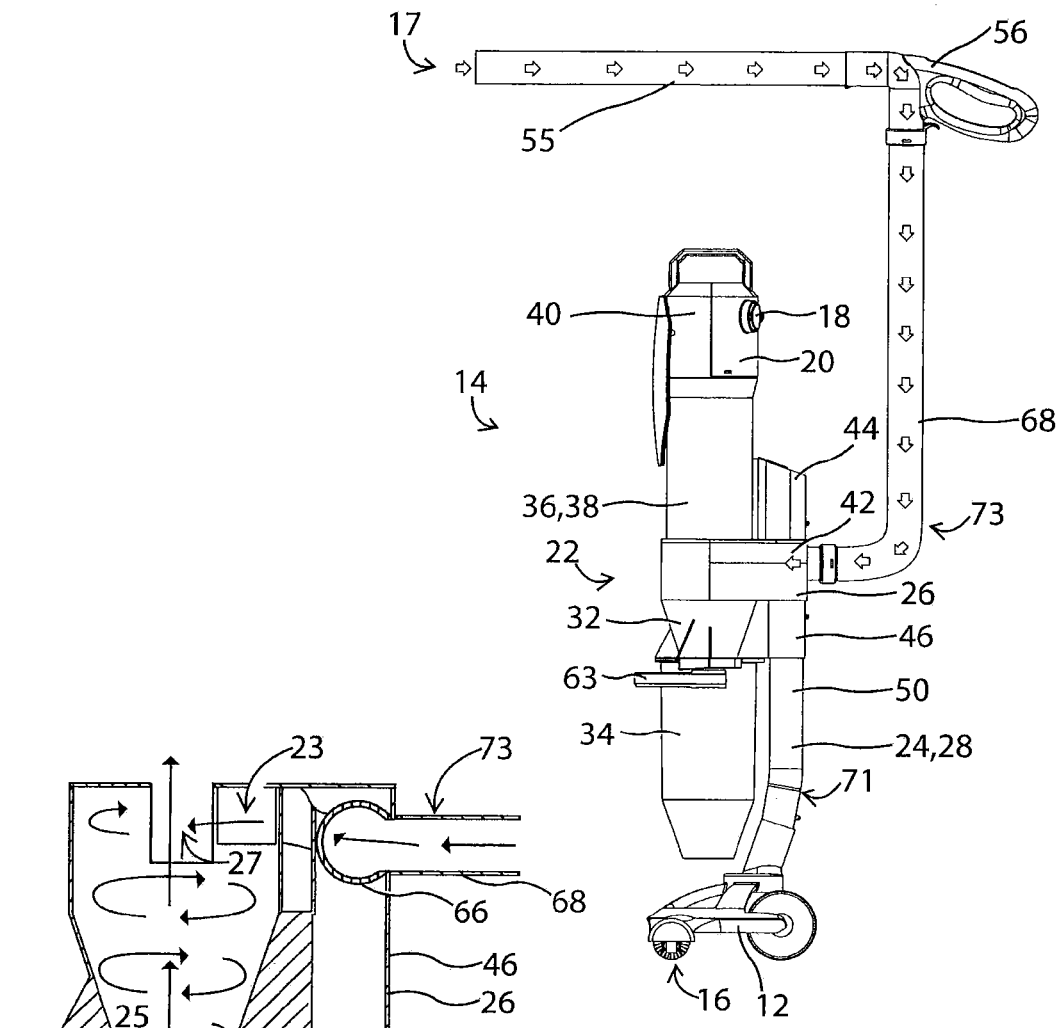
FIG. 28 is a side elevational view of the vacuum cleaner of FIG. 29 showing the air flow from the inlet of the cleaning wand to the cyclone inlet.
Figure 27:
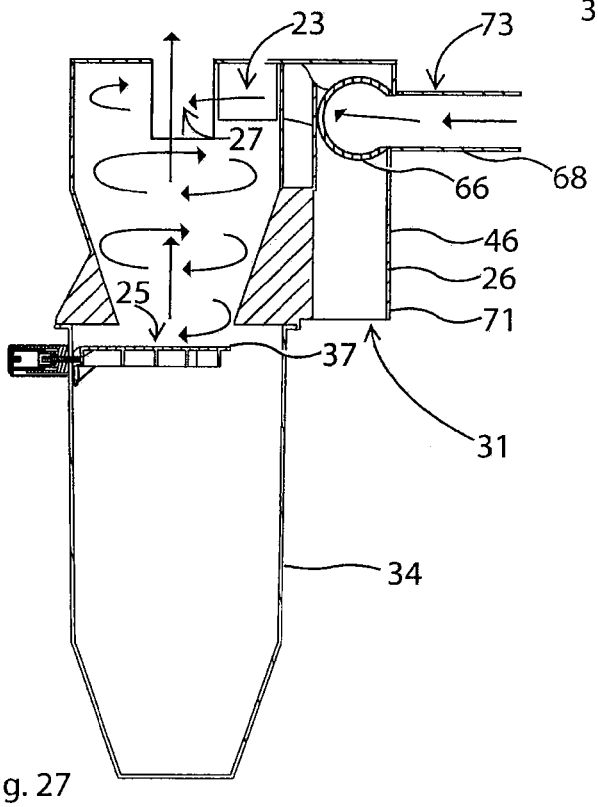
FIG. 27 is a cross section through the cyclone housing and dirt chamber of the vacuum cleaner of FIG. 26 wherein the vacuum cleaner is in the above floor cleaning mode.

Alternately, it will be appreciated that plate 37 may be removably mounted, either to dirt chamber 34 or cyclone housing 32 (as exemplified in FIG. 22*e*). Accordingly, a plate having a different configuration, e.g., convex as exemplified in FIG. 23, may re selectively inserted. Alternately, as exemplified in FIG. 23, a control 90 may be provided which, when actuated, will cause plate 37 to change its configuration. For example, a plurality of cables may extend underneath plate 37 and be connected to a take up reel, which is driven by rotation of control 90. Accordingly, when control 90 is turned and draws the cable onto the reel, plate 37 will deform to a position shown in FIG. 26. When control 90 is rotated in the opposite direction, the elasticity of plate 37 will cause it to revert to its original shape (e.g. flat).

Figure 21A:
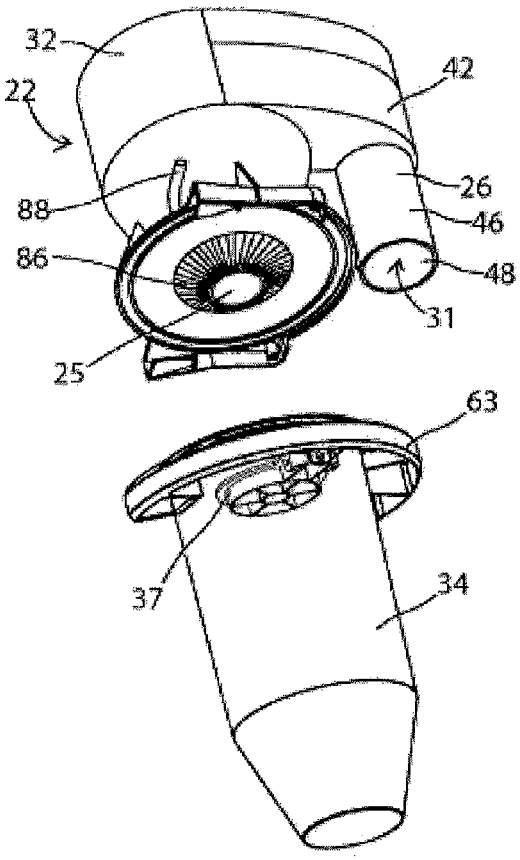
FIG. 21*a* is an exploded view of a cyclone housing showing an iris for the outlet of the cyclone chamber in a first position.
Figure 21B:
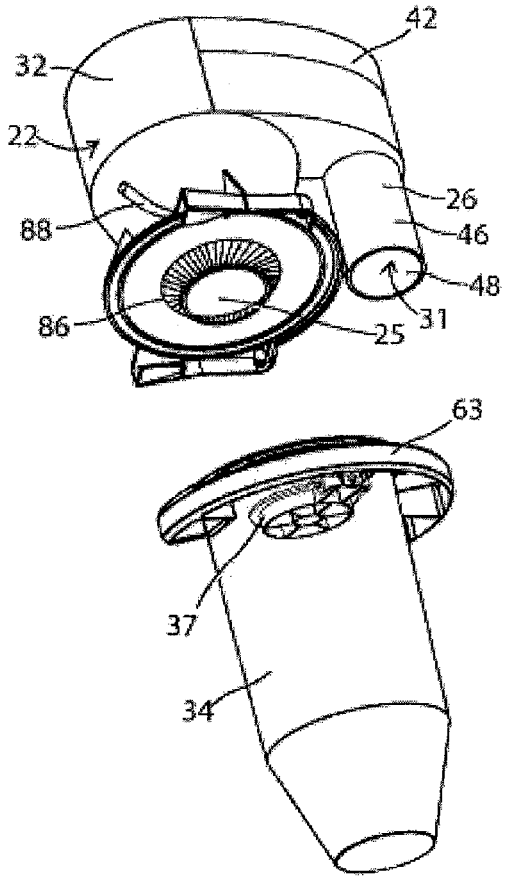
FIG. 21*b* is an exploded view of the cyclone housing and dirt chamber of FIG. 24*a* showing the iris in a second position.

In some embodiments, the size of dirt outlet 25 may be variable. For example, as shown in FIGS. 21*a* and 21*b*, an iris 86 may be provided. The size of the opening 25 defined by iris 86 may be controlled by adjustable lever 88. The outer surface of cyclone housing 32 may have a scale provided thereon, or labeled positions defining the preferred position for lever 88 (and accordingly the size of opening of iris 86) for different types of dirt.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. An upright surface cleaning apparatus having a cyclonic cleaning stage and comprising:

(a) a surface cleaning head having a dirty fluid inlet;

(b) a fluid flow path extending from the dirty fluid inlet to a clean air outlet of the upright surface cleaning apparatus;

(c) an upright section comprising a support member, the upright section moveably mounted to the surface cleaning head;

(d) a cleaning and suction unit removable and useable as a portable surface cleaning apparatus, the cleaning and suction unit comprising a suction motor, an above floor cleaning wand having an air inlet and an air outlet and at least one cyclone having a cyclone inlet and a cyclone chamber;

(e) a mounting assembly removably mounting the cleaning and suction unit to the upright section of the upright surface cleaning apparatus, the mounting assembly having an upper section having an opening for removably receiving an end of the above floor cleaning wand and a lower section having an opening for removably receiving an end of the support member with the opening of the upper section and the opening of the lower section being substantially aligned with one another; and, (f) at least two operating components of the upright surface cleaning apparatus including the cyclonic cleaning stage mounted directly or indirectly to the mounting assembly and wherein an airflow passage from the at least one cyclone chamber to the suction motor is spaced apart from the opening in the upper section of the mounting assembly.

2. The upright surface cleaning apparatus of claim 1 wherein the support member comprises an airflow duct forming part of the fluid flow path.

3. The upright surface cleaning apparatus of claim 2 wherein the airflow duct is an up flow duct and the mounting assembly member has an airflow passage therethrough in air flow communication with the cyclonic cleaning stage.

4. The upright surface cleaning apparatus of claim 1 wherein at least one of the operating components is removably mounted to the mounting assembly member.

5. The upright surface cleaning apparatus of claim 1 further comprising an above floor cleaning wand mounted to the mounting assembly or an operating component mounted to thereto.

6. The upright surface cleaning apparatus of claim 1 wherein the cyclonic cleaning stage and the suction motor are mounted directly to the mounting assembly.

7. The upright surface cleaning apparatus of claim 1 wherein the support member comprises an air flow duct forming part of the fluid flow path.

8. The surface cleaning apparatus of claim 1 wherein the mounting assembly further comprises an air flow valve positioned generally aligned horizontally with a position at which air exits the cyclone inlet and enters the cyclone chamber when the surface cleaning apparatus is in an upright storage configuration.

9. The surface cleaning apparatus of claim 1 wherein the mounting assembly is positioned rearward of the suction and cleaning unit.

10. The surface cleaning apparatus of claim 1 wherein the suction and cleaning unit has an air inlet in a side wall thereof.

11. The surface cleaning apparatus of claim 1 wherein the opening of the upper section has a longitudinal axis and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the longitudinal axis of the opening of the upper section.

12. The surface cleaning apparatus of claim 11 wherein the above floor cleaning wand includes a flexible hose and the flexible hose is connected to an air inlet of the mounting assembly that is generally perpendicular to the longitudinal axis of the opening of the upper section.

13. The surface cleaning apparatus of claim 1 wherein the air inlet of the above floor cleaning wand is removably received in the opening of the upper section and the above floor cleaning wand further comprises a handle, whereby the handle is drivingly connected to the surface cleaning head when the cleaning and suction unit is mounted to the upright section.

14. The surface cleaning apparatus of claim 13 wherein the tubular support member is the upright section.

15. An upright surface cleaning apparatus comprising:

(a) a surface cleaning head having an airflow path from a first dirty fluid inlet to a clean air outlet;

(b) an above floor cleaning wand having a second dirty fluid inlet at one end thereof and a handle for the upright surface cleaning apparatus distal thereto;

(c) an upright section pivotally mounted to the surface cleaning head between a storage position and an in use position and comprising a removable cleaning and suction unit useable as a portable surface cleaning apparatus, the cleaning and suction unit comprising, a mounting assembly, a suction motor positioned in the airflow path, a cyclonic cleaning stage and the above floor cleaning wand, the cyclonic cleaning stage selectively connectable in fluid flow communication with the first dirty fluid inlet and the second dirty fluid inlet, the second dirty fluid inlet is removably connectable directly to the mounting assembly, the above floor cleaning wand extending along a first longitudinal axis when the second dirty fluid inlet is connected to the mounting assembly, the mounting assembly comprising a mounting assembly air outlet that is downstream of the second dirty fluid inlet and that communicates with an inlet of the cleaning and suction unit, the mounting assembly air outlet has a longitudinal axis that is generally perpendicular to the first longitudinal axis;

(d) the cyclonic cleaning stage having a longitudinally extending outer surface, a cyclone chamber and a cyclone inlet having an outlet end through which air exits the cyclone inlet and enters the cyclone chamber; and, the wand with the handle drivingly connected to the surface cleaning head when the upright section is in the in use position (f).

16. The upright surface cleaning apparatus of claim 1 wherein the suction motor is mounted above the cyclonic cleaning stage.

17. The upright surface cleaning apparatus of claim 15 further comprising an up flow duct the is removably connectable to the mounting assembly in the fluid flow path from the first dirty fluid inlet to the cyclonic cleaning stage.

18. The upright surface cleaning apparatus of claim 15 wherein the cyclonic cleaning stage is removably mounted to the upper section.

19. The upright surface cleaning apparatus of claim 15 wherein the cyclonic cleaning stage comprises at least one collection chamber and the collection chamber is removably mounted to the cyclonic cleaning stage.

20. The upright surface cleaning apparatus of claim 17 wherein the upflow duct is a support member and the mounting assembly is mounted to the upflow duct.

21. The surface cleaning apparatus of claim 15 wherein the mounting assembly further comprises an air flow valve.

22. The surface cleaning apparatus of claim 17 wherein the second dirty fluid inlet and the upflow duct are axially aligned when the suction and cleaning unit is configured for use as an upright surface cleaning apparatus.

23. The surface cleaning apparatus of claim 15 wherein the mounting assembly is positioned rearward of the suction and cleaning unit.

24. The surface cleaning apparatus of claim 15 wherein the air inlet of the suction and cleaning unit is in a sidewall thereof.

25. The surface cleaning apparatus of claim 15 wherein the above floor cleaning wand includes a flexible hose and the flexible hose is connected to a mounting assembly air inlet that is perpendicular to the first longitudinal axis.

26. An upright surface cleaning apparatus operable in an upright configuration and a portable configuration, the upright surface cleaning apparatus comprising:

(a) a surface cleaning head having a first dirty fluid inlet;

(b) a support member moveably mounted to the surface cleaning head;

(c) upright section comprising a cleaning and suction unit removable and useable when removed from the support member, the cleaning and suction unit comprising an above floor cleaning wand, a mounting assembly positioned on a side of the cleaning and suction unit and removably mountable to the support member, a suction motor and a cyclonic cleaning stage; and (d) a fluid flow path from the first dirty fluid inlet to the cyclonic cleaning stage and including a transverse passage, which extends generally transverse to the support member, and connects with a side wall inlet of the cleaning and suction unit, wherein, when the upright surface cleaning apparatus is the upright configuration, the surface cleaning head, the support member and the upright section define an assembly and wherein the above floor cleaning wand and the support member are substantially axially aligned with one another when connected to the mounting assembly and wherein an airflow passage from the cyclonic cleaning stage to the suction motor is spaced apart from the cleaning wand.

27. The upright surface cleaning apparatus of claim 26 wherein the support member has an air flow passage therein and forms part of the fluid flow path from the first dirty fluid inlet to the cyclonic cleaning stage.

28. The upright surface cleaning apparatus of claim 27 wherein the support member is tubular.

29. The upright surface cleaning apparatus of claim 26 further comprising a flexible hose that forms part of an air flow path from a hose dirty air inlet wherein the flexible hose has an air outlet end located at the transverse passage.

30. The upright surface cleaning apparatus of claim 29 further comprising an above floor cleaning wand having a second dirty fluid inlet and the above floor cleaning wand is connected to a upstream end of the flexible hose.

31. The surface cleaning apparatus of claim 26 wherein the mounting assembly further comprises an air flow valve.

32. The surface cleaning apparatus of claim 26 wherein the support member is connected to a lower portion of the mounting assembly and the above floor cleaning wand is connected to an upper section of the mounting assembly.

33. The surface cleaning apparatus of claim 26 wherein the mounting assembly is positioned rearward of the suction and cleaning unit.

34. The surface cleaning apparatus of claim 26 wherein the suction and cleaning unit has an air inlet in a side wall thereof.

35. The surface cleaning apparatus of claim 26 wherein the above floor cleaning wand extends along a first longitudinal axis when connected to the mounting assembly and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the first longitudinal axis.

36. The surface cleaning apparatus of claim 35 wherein the above floor cleaning wand includes a flexible hose and the flexible hose is connected to a mounting assembly air inlet that is perpendicular to the first longitudinal axis.

37. The surface cleaning apparatus of claim 26 wherein the air inlet of the above floor cleaning wand is removably connectable to an upper section of the mounting assembly and the above floor cleaning wand further comprises a handle, whereby the handle is drivingly connected to the surface cleaning head when the cleaning and suction unit is mounted to the upright section.

38. The surface cleaning apparatus of claim 37 wherein the support member is the upright section.

39. An upright surface cleaning apparatus operable in an upright configuration and a portable configuration, the upright surface cleaning apparatus comprising:

(a) a surface cleaning head having a first dirty fluid inlet;

(b) a support member moveably mounted to the surface cleaning head; and.

(c) upright section comprising a handle connected to a mounting assembly and whereby the handle is drivingly connected to the surface cleaning head, and a cleaning and suction unit, the mounting assembly is positioned on a side of the cleaning and suction unit and the suction and cleaning unit is removable and useable when removed from the support member, the support member is removably mounted to the mounting assembly and the cleaning and suction unit comprises a suction motor and a cyclonic cleaning stage comprising at least one cyclone;

wherein, in the upright configuration, an upright assembly is provided that comprises the surface cleaning head, the support member and the upright section and, when in a portable configuration a portable assembly is provided that comprises the cleaning and suction unit and wherein the above floor cleaning wand and the support member are substantially axially aligned with one another when connected to the mounting assembly and wherein an airflow passage from the cyclonic cleaning stage to the suction motor is spaced apart from the cleaning wand.

40. The upright surface cleaning apparatus of claim 39 wherein the support member has an air flow passage therein and forms part of the fluid flow path from the first dirty fluid inlet to the cyclonic cleaning stage.

41. The upright surface cleaning apparatus of claim 40 wherein the support member is tubular.

42. The upright surface cleaning apparatus of claim 40 further comprising a flexible hose and an above floor cleaning wand that forms part of an air flow path to the cyclonic cleaning stage in the upright assembly and the portable assembly and is mounted to the mounting assembly.

43. The upright surface cleaning apparatus of claim 40 further comprising a flexible hose and an above floor cleaning wand that forms part of the upright assembly and part of the portable assembly.

44. The surface cleaning apparatus of claim 39 further comprising a fluid flow path from the first dirty fluid inlet to the cyclonic cleaning stage and the mounting assembly forms part of the fluid flow path.

45. The surface cleaning apparatus of claim 44 wherein the fluid flow path includes an upstream portion that extends to a height about that at which air enters a cyclone chamber of the cyclonic cleaning stage when the surface cleaning apparatus is in a storage configuration and a second portion that extends transversely from a position exterior to the cyclone to the cyclone inlet.

46. The surface cleaning apparatus of claim 39 wherein the mounting assembly further comprises an air flow valve.

47. The surface cleaning apparatus of claim 42 wherein the support member is connected to a lower portion of the mounting assembly and the above floor cleaning wand is connected to an upper section of the mounting assembly.

48. The surface cleaning apparatus of claim 39 wherein the mounting assembly is positioned rearward of the suction and cleaning unit.

49. The surface cleaning apparatus of claim 42 wherein the suction and cleaning unit has an air inlet in a side wall thereof.

50. The surface cleaning apparatus of claim 42 wherein the above floor cleaning wand extends along a first longitudinal axis when connected to the mounting assembly and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the longitudinal axis of the opening of the upper section.

51. The surface cleaning apparatus of claim 50 wherein the above floor cleaning wand includes a flexible hose and the flexible hose is connected to a mounting assembly air inlet that is perpendicular to the first longitudinal axis.

52. The surface cleaning apparatus of claim 42 wherein the air inlet of the above floor cleaning wand is removably connectable to an upper section of the mounting assembly and the above floor cleaning wand further comprises the handle.

53. The surface cleaning apparatus of claim 42 wherein the support member is the upright section.

54. An upright surface cleaning apparatus operable in an upright configuration and a portable configuration, the upright surface cleaning apparatus comprising:

(a) a surface cleaning head having a first dirty fluid inlet;

(b) a support member moveably mounted to the surface cleaning head;

(c) an upright section comprising an upright section handle drivingly connected to the surface cleaning head and a cleaning and suction unit removable and useable when removed from the support member, the cleaning and suction unit comprising a suction motor, and a cyclonic cleaning stage;

(d) a fluid flow path from the first dirty fluid inlet to the cleaning and suction unit, (e) an above floor cleaning wand moveable between a floor cleaning position and an above floor cleaning position, the above floor cleaning wand including a handle; and, (f) a housing provided on the cleaning and suction unit and comprising an interface for the support member and the above floor cleaning wand and includes a portion of the fluid flow path, and wherein, in the upright configuration, an upright assembly is provided that comprises the surface cleaning head, the support member and the upright section and, when in the portable configuration a portable assembly is provided that comprises the cleaning and suction unit and the upright section and wherein the above floor cleaning wand and the support member are substantially axially aligned with one another when connected to the interface and wherein an airflow passage from the cyclonic cleaning stage to the suction motor is spaced apart from the cleaning wand.

55. The surface cleaning apparatus of claim 54 wherein the support member is connected to a lower portion of the housing and the above floor cleaning wand is connected to an upper section of the housing.

56. The surface cleaning apparatus of claim 54 wherein the housing is positioned rearward of the suction and cleaning unit.

57. The surface cleaning apparatus of claim 54 wherein the suction and cleaning unit has an air inlet in a side wall thereof.

58. The surface cleaning apparatus of claim 54 wherein the above floor cleaning wand extends along a first longitudinal axis when connected to the housing and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the longitudinal axis of the opening of the upper section.

59. The surface cleaning apparatus of claim 58 wherein the above floor cleaning wand includes a flexible hose and the flexible hose is connected to a mounting assembly air inlet that is perpendicular to the first longitudinal axis.

60. The surface cleaning apparatus of claim 54 wherein the air inlet of the above floor cleaning wand is removably connectable to an upper section of the housing, whereby the handle is drivingly connected to the surface cleaning head when the cleaning and suction unit is mounted to the upright section.

61. The surface cleaning apparatus of claim 54 wherein the support member is the upright section.

62. An upright surface cleaning apparatus comprising:

(a) a floor cleaning unit comprising a surface cleaning head having a dirty air inlet and a support member moveably mounted thereto;

(b) an upright section comprising a handle and a cleaning and suction unit removable and useable when removed from the support member, the suction and cleaning unit including a mounting assembly, a suction motor and a cyclonic cleaning stage;

(c) an above floor cleaning air flow path including an above floor cleaning wand;

(d) an air flow conduit extending from the surface cleaning head to the cleaning and suction unit and including an upflow duct; and, (e) the upflow duct connected to a lower portion of the mounting assembly and the above floor cleaning wand connected to an upper section of the mounting assembly, the portable surface cleaning apparatus comprising an air flow passage from an inlet to an air outlet and the suction motor in the air flow passage, wherein the above floor cleaning wand and the upflow duct are substantially axially aligned with one another when connected to the mounting assembly and wherein an airflow passage from the cyclonic cleaning stage to the suction motor is spaced apart from the cleaning wand.

63. The surface cleaning apparatus of claim 62 wherein the handle drivingly connected to the surface cleaning head comprises the above floor cleaning wand which is drivingly connected to the upflow duct.

64. The surface cleaning apparatus of claim 62 wherein the support member is connected to a lower portion of the mounting assembly and the above floor cleaning wand is connected to an upper section of the mounting assembly.

65. The surface cleaning apparatus of claim 62 wherein the mounting assembly is positioned rearward of the suction and cleaning unit.

66. The surface cleaning apparatus of claim 62 wherein the suction and cleaning unit has an air inlet in a side wall thereof.

67. The surface cleaning apparatus of claim 62 wherein the above floor cleaning wand extends along a first longitudinal axis when connected to the mounting assembly and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the longitudinal axis of the opening of the upper section.

68. The surface cleaning apparatus of claim 67 wherein the above floor cleaning wand includes a flexible hose and the flexible hose is connected to a mounting assembly air inlet that is perpendicular to the first longitudinal axis.

69. The surface cleaning apparatus of claim 62 wherein the air inlet of the above floor cleaning wand is removably connectable to an upper section of the mounting assembly, whereby the handle is drivingly connected to the surface cleaning head when the cleaning and suction unit is mounted to the upright section.

70. The surface cleaning apparatus of claim 62 wherein the support member is the upright section.

71. A surface cleaning apparatus comprising:

(a) a floor cleaning unit comprising a surface cleaning head having a dirty air inlet, a cleaning head air outlet and an upright section drivingly connected to the surface cleaning head;

(b) a cleaning and suction unit removably mounted to the surface cleaning apparatus and having an air inlet, an air outlet, a cyclonic cleaning stage and a suction motor;

(c) an air flow path extending through the surface cleaning apparatus from the dirty air inlet to the air outlet;

(d) a mounting member provided on a side of the cleaning and suction unit and having an air flow passage therein and removable with the cleaning and suction unit, a support member moveably mounted to the surface cleaning head and connected to the mounting member;

(e) an above floor cleaning wand connected to the mounting member; wherein the above floor cleaning wand and the support member are substantially axially aligned with one another when connected to the mounting member and wherein the surface cleaning apparatus has at least two operating modes comprising:

(i) a first upright operating mode wherein the surface cleaning apparatus is operable with the cleaning and suction unit and forming part of the air flow path; and, (ii) a second operating mode wherein the cleaning and suction unit is operable when removed from the surface cleaning head and wherein an airflow passage from the cyclonic cleaning stage to the suction motor is spaced apart from the cleaning wand.

72. The surface cleaning apparatus of claim 71, wherein the support member is an upflow duct.

73. The surface cleaning apparatus of claim 71, wherein the mounting member is mounted on an upper end of the support member.

74. The surface cleaning apparatus of claim 71 wherein cleaning and suction unit includes a cyclone having a cyclone inlet and the mounting member has an air outlet laterally spaced from and generally axially aligned with the cyclone inlet.

75. The surface cleaning apparatus of claim 71 wherein the support member is connected to a lower portion of the mounting member and the above floor cleaning wand is connected to an upper section of the mounting member.

76. The surface cleaning apparatus of claim 71 wherein the mounting member is positioned rearward of the suction and cleaning unit.

77. The surface cleaning apparatus of claim 71 wherein the suction and cleaning unit has an air inlet in a side wall thereof.

78. The surface cleaning apparatus of claim 71 wherein the above floor cleaning wand extends along a first longitudinal axis when connected to the mounting member and the mounting assembly further comprises a mounting assembly air outlet that is downstream of the air inlet of the above floor cleaning wand and that communicates with an inlet of the cleaning and suction unit, the mounting assembly air outlet has a longitudinal axis that is generally perpendicular to the longitudinal axis of the opening of the upper section.

79. The surface cleaning apparatus of claim 78 wherein the above floor cleaning wand includes a flexible hose and the flexible hose is connected to a mounting assembly air inlet that is perpendicular to the first longitudinal axis.

80. The surface cleaning apparatus of claim 71 wherein an air inlet of the above floor cleaning wand is removably connectable to an upper section of the mounting member, whereby a handle is drivingly connected to the surface cleaning head when the cleaning and suction unit is mounted to the support member.

81. The surface cleaning apparatus of claim 80 wherein the support member is an upflow duct.

* * * * *

UNITED STATES PATENT AND TRADEMARK OFFICE

CERTIFICATE OF CORRECTION

PATENT NO. : 8,166,607 B2
APPLICATION NO. : 11/954310
DATED : May 1, 2012
INVENTOR(S) : Wayne Ernest Conrad It is certified that error appears in the above-identified patent and that said Letters Patent is hereby corrected as shown below:

Col. 12, Claim 3, line 52, "wherein the airflow duct is an up flow duct and the mounting assembly member has" should read --wherein the airflow duct is an up flow duct and the mounting assembly has--.

Col. 12, Claim 4, line 56, "wherein at least one of the operating components is removably mounted to the mounting assembly member" should read --wherein at least one of the operating components is removably mounted to the mounting assembly.--.

Col. 13, Claim 15, line 4, "(f)." should be removed.

Col. 14, Claim 16, line 5, "The upright surface cleaning apparatus of claim 1 wherein" should read --The upright surface cleaning apparatus of claim 15 wherein--.

Col. 17, Claim 54, line 21, "upright section and wherein the above floor cleaning" should read --upright section handle and wherein the above floor cleaning--.

Signed and Sealed this
Nineteenth Day of June, 2012

David J. Kappos

David J. Kappos
*Director of the United States Patent and Trademark Office*